US011001928B2

(12) United States Patent
Utsumi et al.

(10) Patent No.: US 11,001,928 B2
(45) Date of Patent: May 11, 2021

(54) SURFACE TREATING APPARATUS

(71) Applicant: C. Uyemura & Co., Ltd., Osaka (JP)

(72) Inventors: Masayuki Utsumi, Osaka (JP); Masaharu Takeuchi, Osaka (JP)

(73) Assignee: C. Uyemura & Co., Ltd., Osaka (JP)

( * ) Notice: Subject to any disclaimer, the term of this patent is extended or adjusted under 35 U.S.C. 154(b) by 0 days.

(21) Appl. No.: 16/727,390

(22) Filed: Dec. 26, 2019

(65) Prior Publication Data

US 2020/0224315 A1 Jul. 16, 2020

(30) Foreign Application Priority Data

Jan. 10, 2019 (JP) ..... JP2019-002872

(51) Int. Cl.
*C23C 18/16* (2006.01)
*C23C 18/18* (2006.01)
*C23C 18/38* (2006.01)

(52) U.S. Cl.
CPC ..... *C23C 18/1632* (2013.01); *C23C 18/1626* (2013.01); *C23C 18/1837* (2013.01); *C23C 18/38* (2013.01)

(58) Field of Classification Search
None
See application file for complete search history.

(56) References Cited

U.S. PATENT DOCUMENTS

2014/0053774 A1* 2/2014 Hotta ..... B05B 16/20 118/423
2014/0116334 A1 5/2014 Hotta et al.
2018/0087140 A1* 3/2018 Utsumi ..... C23C 4/04
2018/0100237 A1* 4/2018 Utsumi ..... C23C 18/1619
2018/0110128 A1* 4/2018 Utsumi ..... H05K 3/227
2018/0117618 A1* 5/2018 Utsumi ..... B05C 11/11

FOREIGN PATENT DOCUMENTS

JP 2014-088600 A 5/2014

OTHER PUBLICATIONS

Notification of Reasons for Refusal (Including Translation) for corresponding Japanese Patent Application No. 2019-002863, dated Sep. 7, 2020.
Notification of Reasons for Refusal (Including Translation) for corresponding Japanese Patent Application No. 2019-002872, dated Sep. 7, 2020.

* cited by examiner

*Primary Examiner* — Jethro M. Pence
(74) *Attorney, Agent, or Firm* — Jason H. Vick; Sheridan Ross, PC

(57) ABSTRACT

In a flow down type surface treating apparatus, a scattering amount of a processing solution is reduced.
A film forming mechanism 110 is provided on an inlet side and an outlet side of each treatment chamber.
The film forming mechanism 110 ejects a continuous laminar liquid under pressure of about 0.01 MPa at a flow rate of 5 to 10 L/min. Such a liquid film prevents droplets reflected on a surface of an antiscattering member 60 from splashing and entering the adjacent treatment chamber. When a plate-like work 10 is shaken to collide with the liquid film, the film flows down along the plate-like work 10 since the film formed by the film forming mechanism 110 is liquid. Thereby, a shake of the plate-like work 10 is converged. An amount of air flowing in toward a transport direction in each treatment chamber is reduced.

11 Claims, 22 Drawing Sheets

60 / ANTISCATTERING MEMBER
61 / THROUGH-HOLE

111 / NOZZLE
113a / LIQUID FILM

92 / PUMP
94 / CHAMBER
110a, 110b / FILM FORMING MECHANISM

60 / HONEYCOMB MEMEBER
81 / VERTICAL PIPE MEMBER
84 / SLOPE
85 / SLOPE
88 / HORIZONTAL PIPE MEMBER

<LOADING SIDE OPENING>

<UNLOADING SIDE OPENING>

SURFACE TREATING APPARATUS

CROSS REFERENCE TO RELATED APPLICATIONS

This application claims the benefit under 35 U.S.C. 119(a) to Japanese Patent Application No. JP 2019-002872, filed Jan. 10, 2019, the entire disclosure of which is incorporated herein by reference in its entirety.

BACKGROUND OF THE INVENTION

Field of the Invention

The present invention relates to a flow down type surface treating apparatus, and more particularly to prevention of liquid splashing into an adjacent treatment chamber.

Background Art

FIG. 10 of Patent Document 1 discloses a flow down type surface treating apparatus in which an antiscattering member is provided under a work.

[Patent Document 1] Japanese Patent Application Publication No. 2014-88600 (JP 2014-88600 A)

As antiscattering members of Patent Document 1, a sponge, a filter, and a fibrous material ("Kasen Rock™" manufactured by Toyo Cushion Co., Ltd.) are disclosed (paragraph 0085 of Patent Document 1). However, these are not always sufficiently effective since droplets hitting the surface of the antiscattering member are reflected as they are. When such reflection occurs, liquid may be mixed into an adjacent treatment chamber.

In order to solve such a problem, a size of a carry-in opening between the treatment chambers may be made substantially the same as that of a substrate to be carried in. However, in that case, even a slight shake of the substrate makes the substrate hit the carry-in opening to stop the carry-in operation.

The present invention is aimed for solving the above-described problem and providing a flow down type surface treating apparatus that enables certain carry-in operation without the liquid being mixed into the adjacent treatment chamber.

The present invention is also aimed for providing the flow down type surface treating apparatus that can prevent the substrate from shaking even if it is a thin substrate that is susceptible to air flow.

SUMMARY OF INVENTION

A surface treating apparatus according to the present invention includes: a first treatment chamber in which a sheet-like treatment object is carried in a vertically held state; a first processing solution flow down mechanism, provided in the first treatment chamber, for squirting a first processing solution to flow down from an upper portion of the carried treatment object over a surface region of the vertically held treatment object; a second treatment chamber adjacent the first treatment chamber in which the treatment object is carried in the vertically held state; a second processing solution flow down mechanism, provided in the second treatment chamber, for squirting a second processing solution to flow down from the upper portion of the carried treatment object over a surface region of the vertically held treatment object; a partition wall, provided between the first treatment chamber and the second treatment chamber, having a carry-in opening that enables the treatment object to be carded in through the carry-in opening in the vertically held state; and a film forming mechanism provided between the first processing solution flow down mechanism in the first treatment chamber and the second processing solution flow down mechanism in the second treatment chamber, that forms a thin layered liquid film along a direction of gravity on a plane orthogonal to a direction in which the treatment object is carried.

This makes it possible to provide the flow down type surface treating apparatus that enables downsizing without the liquid being mixed into the adjacent treatment chamber.

A state defined by the term "flow down from the upper portion to the lower portion" is not limited as long as it results in a state of the processing solution flowing down from the upper portion to the lower portion of the treatment object, and it includes a case where the processing solution is directly squirted toward the treatment object to flow down and a case where the processing solution is indirectly applied to flow down through a holding part that holds the treatment object.

Features, other objectives, uses, effects, and the like of the present invention will become apparent by referring to the embodiments and the drawings.

DETAILED DESCRIPTION OF THE PREFERRED EMBODIMENTS

1. First Embodiment

Figure 1:
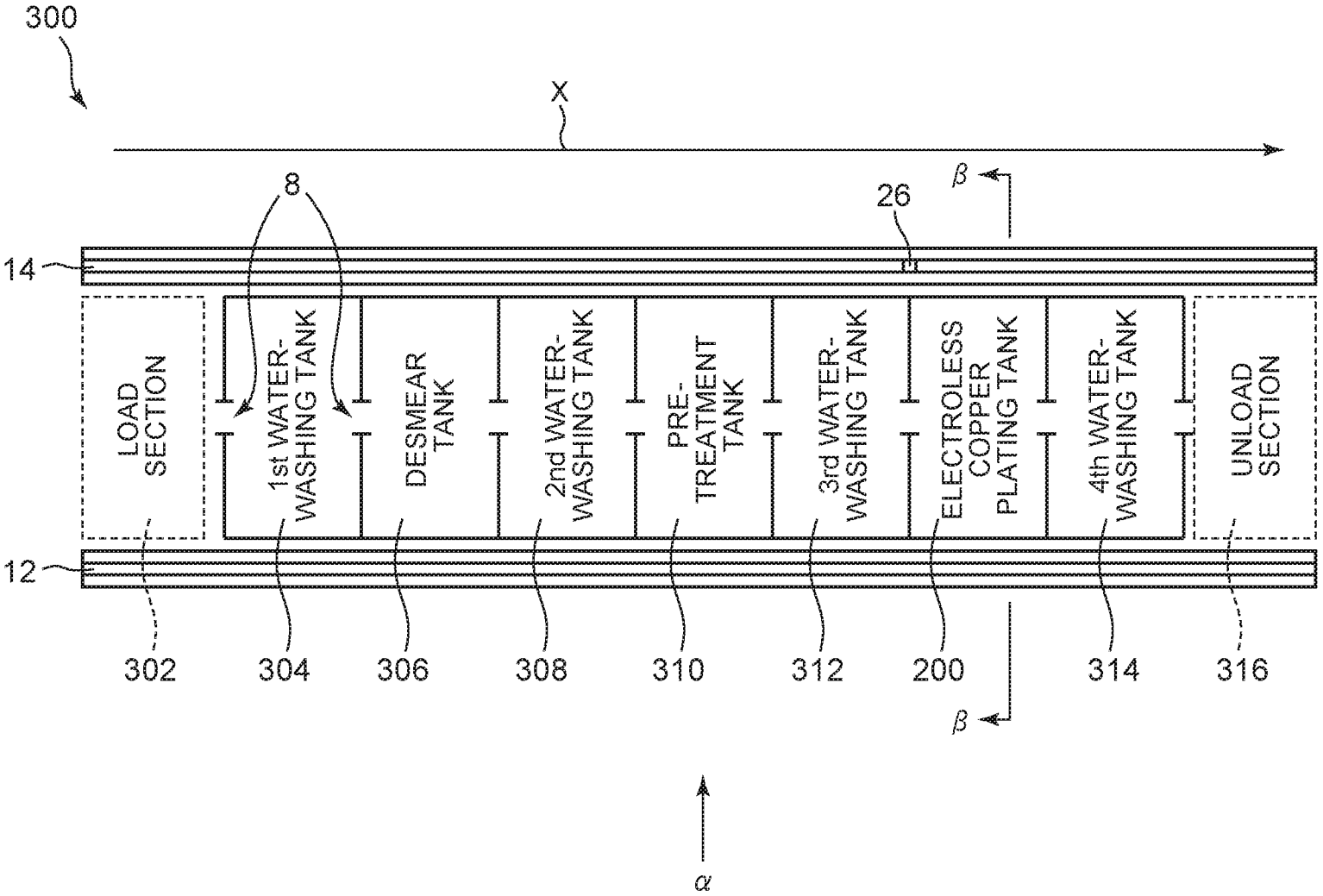
FIG. 1 is an arrangement plan of a surface treating apparatus 300 seen from above.
Figure 2:
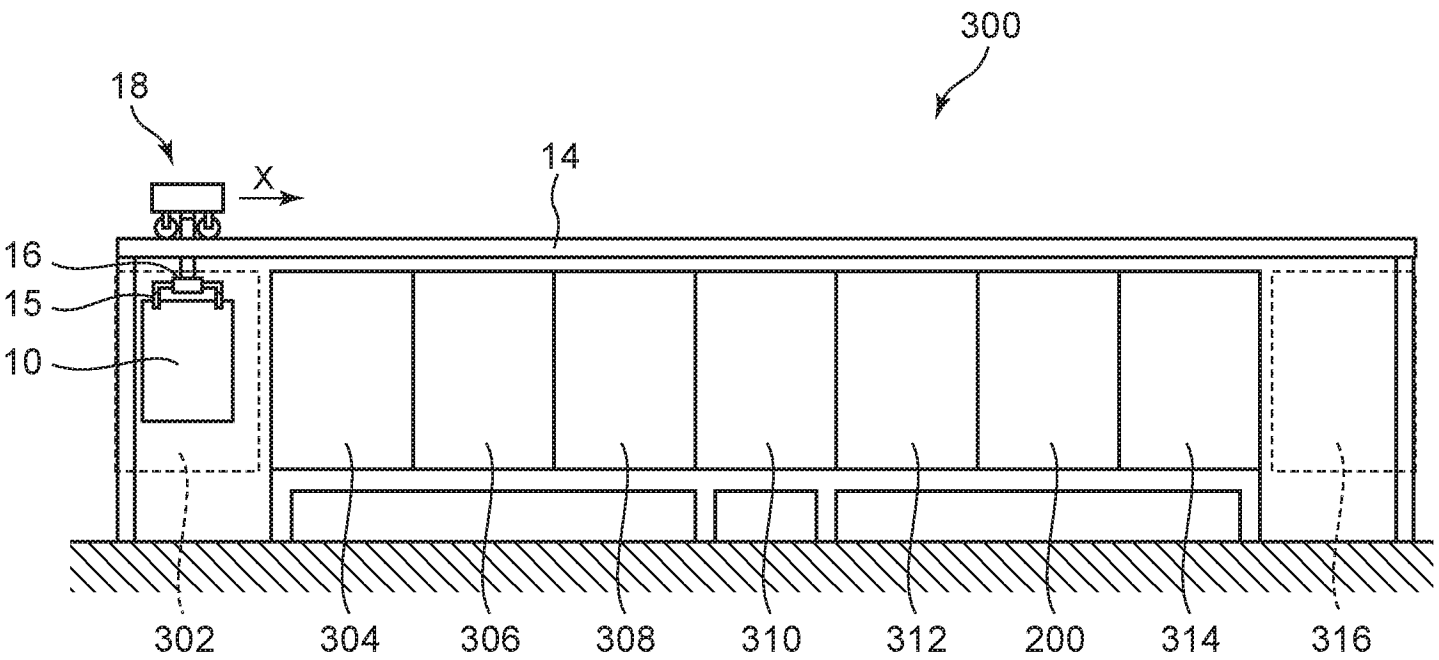
FIG. 2 is a side view of the surface treating apparatus 300 seen from alpha direction.

First, a structure of a surface treating apparatus 300 of the present invention will be described with reference to FIGS. 1 and 2. FIG. 1 is an arrangement plan of the surface treating apparatus 300 seen from above. FIG. 2 is a side view of the surface treating apparatus 300 shown in FIG. 1 seen from direction alpha. In FIG. 1, a transport hanger 16 and a transport mechanism 18 shown in FIG. 2 are omitted.

As shown in FIG. 1, along the transport direction X of a plate-like work 10 (FIG. 2) as a treatment object, the surface treating apparatus 300 includes a load section 302, a 1st water-washing tank 304, a desmear tank 306, a 2nd water-washing tank 308, a pre-treatment tank 310, a 3rd water-washing tank 312, an electroless copper plating tank 200, a 2nd water-washing tank 314, and an unload section 316 arranged in sequence. Each process for electroless copper plating is performed in this order. Each tank has cutout(s) 8 (FIG. 1) forming a passage of transport hanger 16 shown in FIG. 2. In addition, each process will hereinafter be described in detail.

Further, the surface treating apparatus 300 includes the transport hanger 16 for transporting the plate-like work 10 in a horizontal direction which is clamped by clamps 15 (FIG. 2) and held vertically, and the transport mechanism 18 for transporting the transport hanger 16 into each tank. FIG. 2 indicates a state that plate-like work 10 is attached to the transport hanger 16 at a load section 302.

After the plate-like work 10 is attached at a load section 302, the transport mechanism 18 starts to move in the horizontal direction X, thereby the plate-like work 10 pass through inside of each tank (electroless copper plating tank 200, etc.). Eventually, the transport mechanism 18 stops at the unload section 316, and the plate-like work 10 that plating has been performed is detached from the transport hanger 16.

Figure 3:
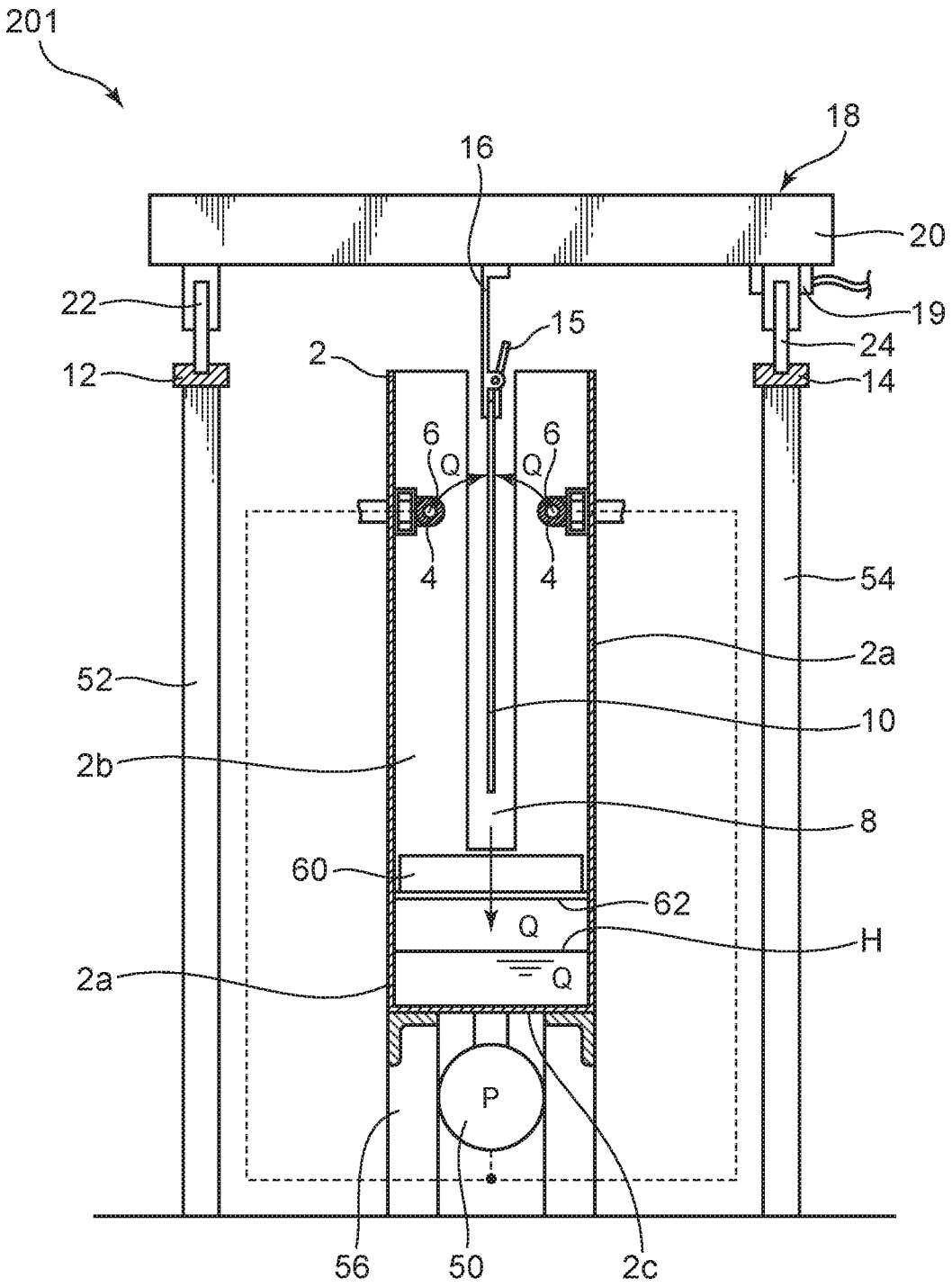
FIG. 3 is a cross-sectional view taken along the line beta—beta in FIG. 1 of an electroless copper plating tank 200 that forms a part of the surface treating apparatus 300.
Figure 4:
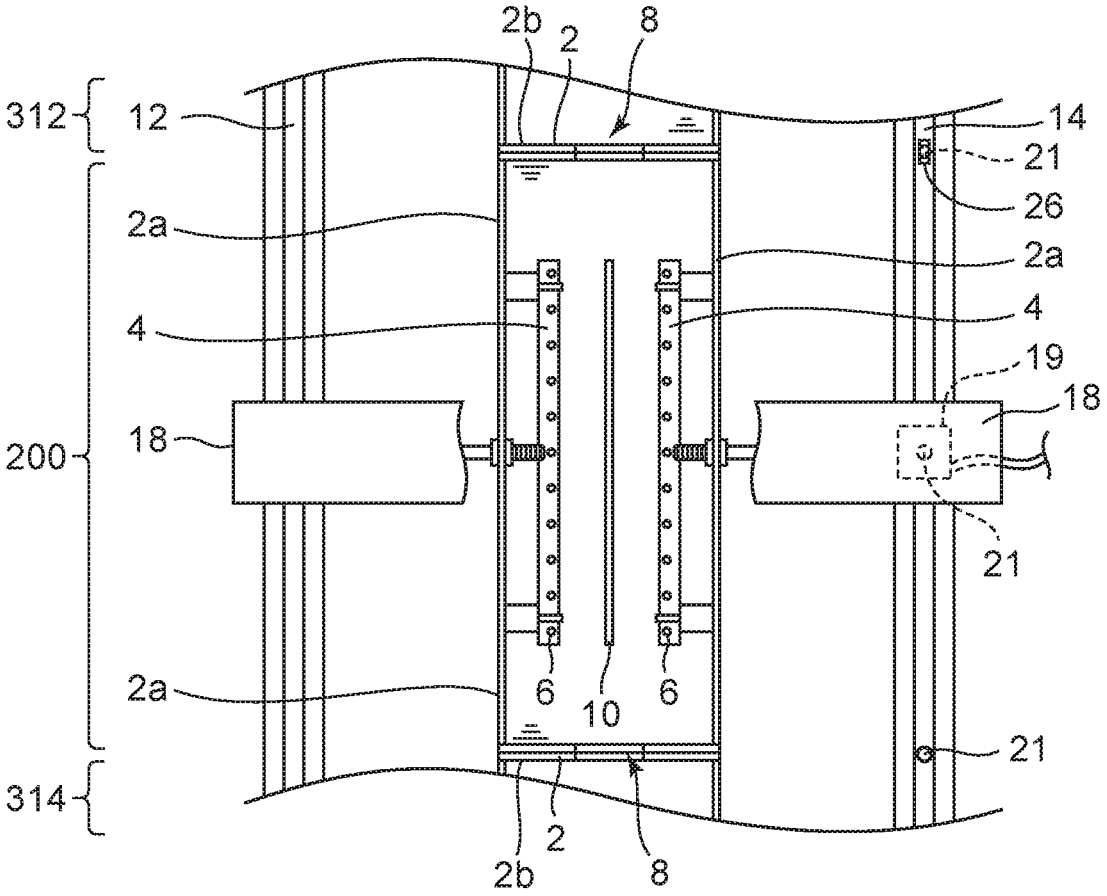
FIG. 4 is a view of the electroless copper plating tank 200 seen from above.

FIG. 3 is a cross-sectional view taken along the line beta—beta of the electroless copper plating tank 200 (FIG. 1) that forms a part of the surface treating apparatus 300. FIG. 4 is a view of the electroless copper plating tank 200 shown in FIG. 3 seen from above. The transport hanger 16 and the transport mechanism 18 are omitted in FIG. 4.

The electroless copper plating tank 200 shown in FIG. 3 includes a tank body 2 mounted on the frame 56 and a circulation pump 50 for circulating the processing solution Q (electroless copper plating solution) accumulated on the bottom in the tank body 2 by supplying with the liquid squirting part 4.

For performing a process on the plate-like work 10, a liquid squirting part 4 which has a squirt port 6 is arranged inside of each tank such as the electroless copper plating tank 200. As shown in FIG. 3, the processing solution is squirted from the squirt port 6 of the liquid squirting part 4 toward the plate-like work 10 obliquely upward to a horizontal plane.

Therefore, the processing solution Q (electroless copper plating solution) is attached to the upper side of the plate-like work 10 which is clamped by the transport hanger 16 inside of the tank body 2. Accordingly, it becomes possible to attach the processing solution Q to the surface of the plate-like work 10 while the processing solution Q is running down the plate-like work 10. In addition, the structure of the liquid squirting part 4 will hereinafter be described in detail.

Thus, a system is employed that circulated processing solution Q runs down the plate-like work 10 without dipping the plate-like work 10 into stored processing solution Q. Therefore, it becomes possible to reduce the total amount of the processing solution Q used for the surface treating apparatus 300 in whole as compared with a dipping type.

An antiscattering member 60 is held by a support part 62 made of a net material. A configuration of the antiscattering member 60 will be described later.

The transport mechanism 18 includes the guide rails 12, 14, a support member 20, and the transport rollers 22, 24 shown in FIG. 3. At the bottom of the support member 20, the transport rollers 22, 24 are installed for movement of the transport mechanism 18 on the guide rails 12, 14. The transport rollers 22, 24 are powered by a motor (not shown). Each of guide rails 12, 14 are fixed on the frames 52, 54. As the plate-like work is transported in such a horizontal direction, there is no need to move up and down. Therefore, it becomes possible to save space because the height of apparatus can be lowered.

As shown in FIG. 3, the transport hanger 16 is fixed below the support member 20 so as to be suspended between two guide rails 12, 14. This makes it possible to reduce a vibration of the plate-like work 10, and also possible to reduce a distortion of structural objects (such as guide rails 12 and 14, frames 52 and 54, etc.) which support the transport mechanism 18.

Also, a plural of magnets 21 are embedded at a predetermined location on the guide rails 12, 14 shown in FIG. 4. The transport mechanism 18 has a magnetic sensor 19 for detecting the magnet 21 on the guide rails 12, 14. The magnetic sensor 19 is installed on the lower side of the support member 20 (one place of the guide rail 14's side).

This allows the transport hanger 16 transported into the electroless copper plating tank 200 to stop at a predetermined location (for example, at the center position of the electroless copper plating tank 200 shown in FIG. 4).

As shown in FIG. 3, the circulation pump 50 installed for each tank is connected to the bottom of the tank body 2, and between the tank body 2 and the liquid squirting part 4 are connected through the circulation pump 50 (indicated by the dotted arrow). This makes it possible to provide the liquid squirting part 4 with the processing solution Q accumulated in the bottom of the tank body 2 again by means of circulation pump 50.

The tank body 2 includes side walls 2*a*, 2*b* and bottom 2*c*, and is formed by assembling these materials such as PVC (polyvinyl chloride) with the use of processing, adhesion, etc., in one united body. The processing solution attached to the plate-like work 10 is received on a downward bottom 2*c* of the tank body 2. In addition, the tank body 2 of the same shape is also used for each tank shown in FIG. 1 other than the electroless copper plating tank 200. That is to say, the structure of each tank is the same, but the type of the processing solution (plating liquid, desmear liquid, washing water) used for each tank is different.

Also, a slit 8 as a cutout is formed so as to extend in a vertical direction on the side wall 2*b* of the tank body 2 shown in FIG. 3. This makes the plate-like work 10 possible to go through the slit 8 when the transport hanger 16 is transported. In addition, if the lower end 8*a* of the slit 8 is too low, the processing solution Q accumulated in the tank body 2 may be overflowed or flowing out.

Therefore, it is required to adjust the supplied amount of the processing solution Q so that the liquid level H (FIG. 3) of the processing solution Q accumulated in the tank body 2 is constantly placed at a position lower than lower end 8*a* of the slit 8. In this embodiment, such a problem is resolved by determining the amount of the processing solution Q so that the liquid level H (FIG. 3) of the processing solution Q accumulated in the tank body 2 is constantly placed at a position lower than lower end 8*a* of the slit 8, and by connecting the tank body 2 and the liquid squirting part 4 through a circulation pump 50.

[Structure of the Liquid Squirting Part 4]

Figure 5:
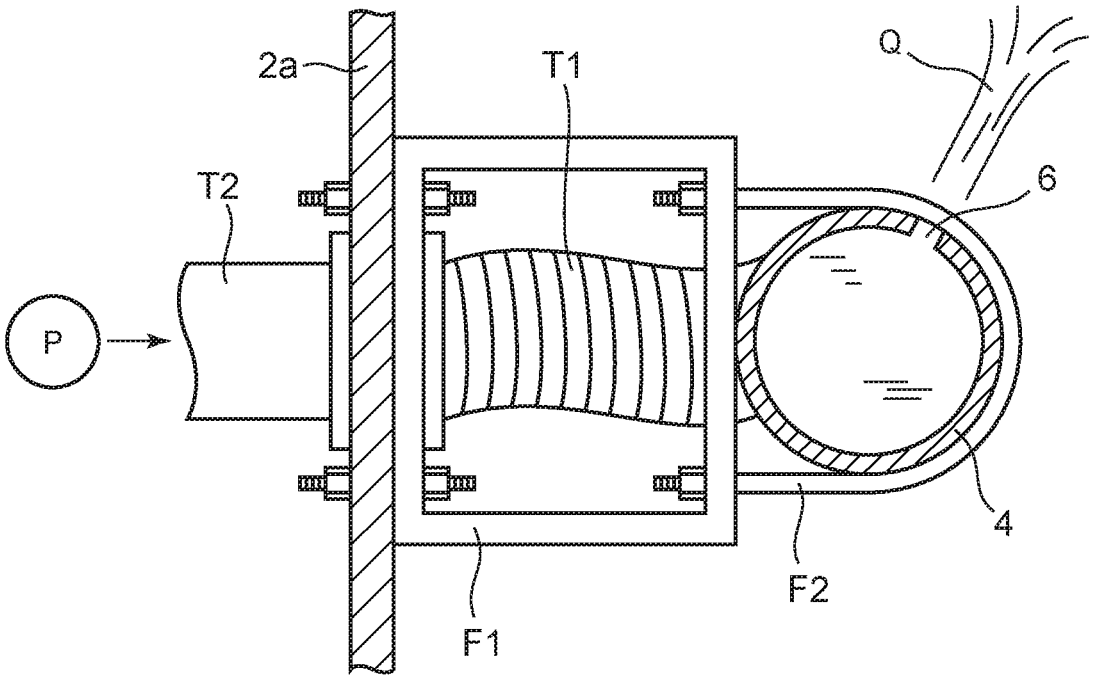
FIG. 5 shows a structure of a liquid squirting part 4.

FIG. 5 shows the structure of the liquid squirting part 4. FIG. 5 is an enlarged view of the liquid squirting part 4 shown in FIG. 3.

As shown in FIG. 5, the liquid squirting part 4 is installed on a base F1, which is configured by fixing a square pipe to the side wall 2*a*, by fastening with the use of two U-shaped fasteners F2. In this embodiment, the liquid squirting part 4 is fastened with the strength to be capable of manually rotating.

As shown in FIG. 4, the liquid squirting part 4 is comprised of a round pipe as a pipe member which has an internal space. Both sides of its longitudinal direction are sealed. Also, the squirt port 6 comprises a plural of holes disposed at predetermined intervals along a longitudinal direction. Further, a flexible pipe T1 and a pipework T2 are connected to the liquid squirting part 4. The flexible pipe T1 and the pipework T2 penetrates through the side wall 2*a* of the tank body. The pipework T2 is connected to a discharge port of the pump 50. Therefore, it is possible to squirt the processing solution Q fed from the pump 50 through the squirt port 6.

Figure 6B:
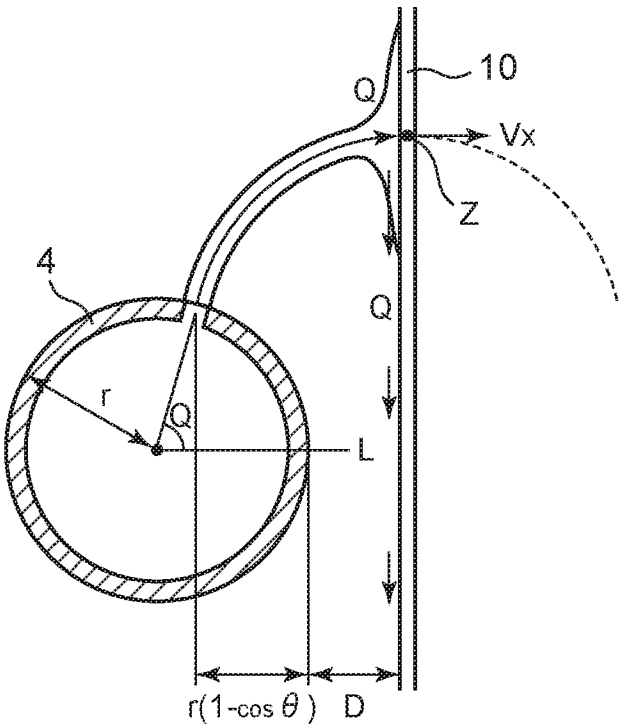
FIGS. 6A and 6B are figures showing a flow of a processing solution Q squirted from a squirt port 6 of the liquid squirting part 4.
Figure 6A:
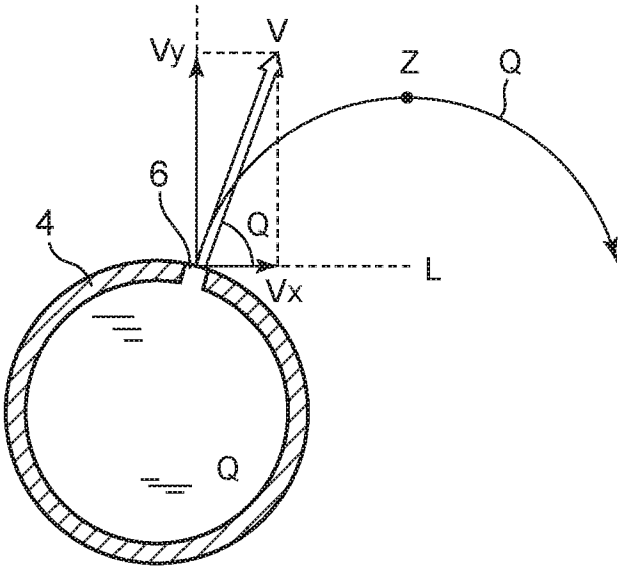

As shown in FIG. 6A, a squirt angle θ of the squirt port 6 is set obliquely upward to the horizontal plane L (for example, ranging from 5 degrees to 85 degrees). Therefore, a liquid current of the processing solution Q squirted from the squirt port 6 moves in a parabolic path. A position of a vertex Z can be determined from a squirt current velocity V and the squirt angle θ of the processing solution Q. In addition, the squirt current velocity V of the processing solution Q depends on the pressure from the pump 50 and the size of the squirt port 6.

In this embodiment, the squirt angle θ is designed so that the processing solution Q squirted at squirt current velocity V can hit against the plate-like work 10 at the vertex Z of the parabola under a condition that the liquid squirting part 4 (radius r) is separated at a predetermined distance D from the plate-like work 10. It becomes possible to inhibit bubbling at the vertex Z of the parabola shown in FIG. 6B. Because the vertical component of velocity Vy of the processing solution Q vanishes, and the horizontal component of velocity Vx (equal to the horizontal component of velocity when it is squirted) only remains.

In addition, as the liquid current hits perpendicular to a surface of the plate-like work 10, the processing solution Q attached to the plate-like work 10 spreads on the surface concentrically and uniformly. Further, it is possible to hit the vicinity of the vertex Z, i.e., forward or backward from the vertex Z by a predetermined distance.

If the processing solution Q is squirted in a horizontal direction or below than the horizontal direction without squirting obliquely upward to the horizontal plane L, the vertical component of velocity Vy of the processing solution Q continues to increase, and the synthesized velocity V also continues to increase by an amount corresponding to it. Accordingly, bubbles occur easily because the processing solution Q attached to the plate-like work 10 scatters in y direction.

As the mentioned above, the occurrence of bubbles when striking the work can be suppressed by squirting the processing solution obliquely upward to the horizontal plane L. This makes it possible to prevent from increasing the amount of the dissolved oxygen in the processing solution Q.

Figure 7:
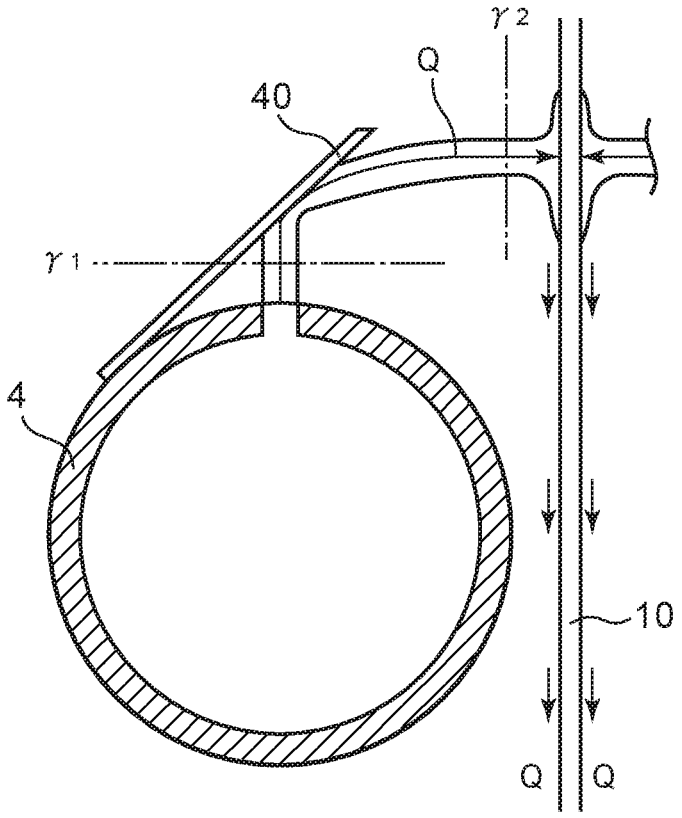
FIG. 7 shows an improvement example that a redirection member 40 is added to the liquid squirting part 4.

In addition, as shown in FIG. 7, a redirection member 40 may be attached to an outer periphery of the liquid squirting part 4 so as to overlap the squirt port 6 for changing the direction of the processing solution Q. Further, the redirection member 40 is spaced from the squirt port 6.

Figure 8A:
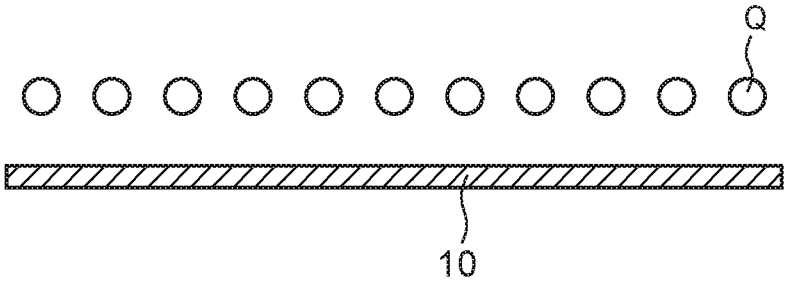
FIGS. 8A and 8B are cross-sectional views of a liquid flow of the processing solution Q before or after attaching to the redirection member 40.
Figure 8B:
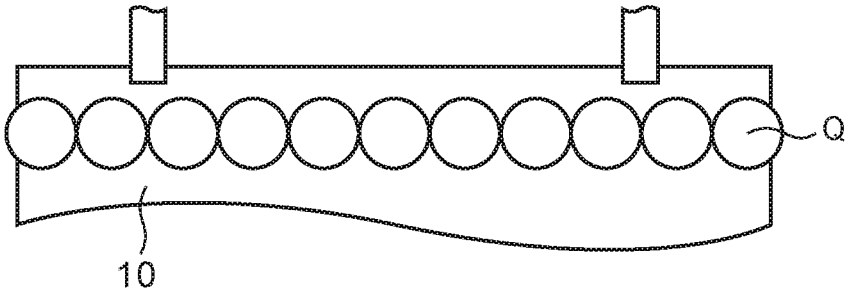

FIG. 7 is an enlarged view illustrating a state that the direction of squirted processing solution Q is redirected by a redirection member 40. FIG. 8A is gamma 1 cross-section view of squirted processing solution Q (before hitting on the redirection member 40). FIG. 8B is gamma 2 cross-section view of the processing solution Q after hitting on the redirection member 40).

If the redirection member 40 is used, the area of liquid flow (section area shown in FIG. 8A) becomes bigger as it hit the redirection member (FIG. 8). Therefore, the liquid flow from each of nearby squirt port 6 are combined (FIG. 8) when attaching to the plate-like work 10, thereby it is possible to uniformize the processing solution Q which is attached to the surface of the plate-like work 10.

That is to say, ideally, it is possible uniformize the liquid flow like a liquid flow squirted through a slit (a long hole) shown in FIG. 21. Also, to describe a parabola as well as the liquid flow squirted through a slit (a long hole), the width of the slit is needed to be narrowed (Because, it is required to attain the same flow rate when squirting that an area of the slit is the same as the sum of area of holes). However, there is a disadvantage that it may be clogged easily. Therefore, holes are formed to achieve the same effect as a slit.

1.2 Each Processing in the Surface Treating Apparatus 300

Figure 9:
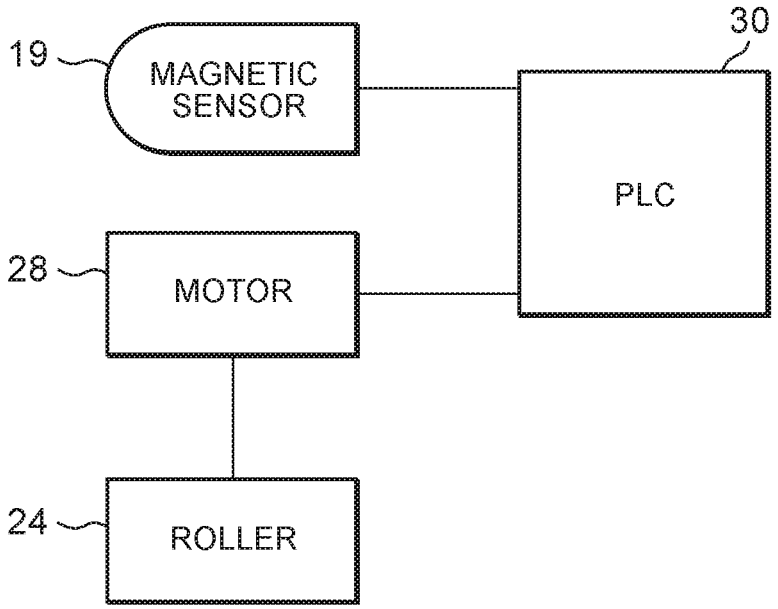
FIG. 9 shows a relation of connection for controlling moving motion of a transport mechanism 18.

Referring to FIG. 9 etc., each process of the surface treating apparatus 300 will be described. In this embodiment, the processing solution Q used for each tank of the surface treating apparatus 300 is constantly circulated by the circulation pump 50 in each tank.

FIG. 9 shows a relation of connection for controlling transferring movement of the transport mechanism 18. As shown in FIG. 9, the magnetic sensor 19 (FIG. 4) connected to a PLC 30, and detects that it is arrived above the magnet which is arranged on the guide rail 14. A signal that the magnetic sensor 19 has been detected is sent to the PLC 30. After receiving a signal, the PLC 30 controls movements (forward, backward, and stop, etc.) of the transport rollers 22, 24 by switching on/off the motor 28.

At first, at the load section 302 shown in FIG. 1, an operator or an installation device (not shown) attaches a plate-like work 10 to be plated to the transport hanger 16 (a state shown in FIG. 2).

Then, as the operator push a transport switch (not shown), the transport hanger 16 moves into the 1st water-washing tank 304 along the guide rails 12, 14. That is, the PLC 30 controls the transport rollers 22, 24 so as to move forward by switching on the motor 28.

Next, at the 1st water-washing tank 304, water-washing a process is performed by applying water to the plate-like work 10 from both sides. The transport hanger 16 stops at the 1st water-washing tank 304 for a predetermined time, then, moves into the desmear tank 306.

For example, after receiving a signal from the magnetic sensor 19 that indicates an arrival at the center of the water-washing tank 304, the PLC 30 controls the motor 28 so as to stop for one minute. Then, the PLC 30 controls the transport rollers 22, 24 so as to move forward by switching on the motor 28. Also, a similar control is performed at the 2nd water-washing tank 308, the 3rd water-washing tank 312, and the 4th water-washing tank 314.

At the desmear tank 306, the transport hanger 16 stops for a predetermined time (for example, 5 minutes), and desmear processing solution (swelling conditioner, resin etching solution, and neutralizing solution, etc.) is applied to the plate-like work 10 from both sides. Here, the desmear process is a process to remove smear (resin) which remains on the plate-like work 10 upon machining such as making a hole, etc.

For example, after receiving a signal from the magnetic sensor 19 that indicates an arrival at the center of the desmear tank 306, the PLC 30 controls the motor 28 so as to stop for five minutes. Then, the transport rollers 22, 24 move forward by switching on the motor 28. A similar process is performed at the pre-treatment tank 310.

Next, at the 2nd water-washing tank 308, water-washing process is performed by applying water to the plate-like work 10 from both sides. The transport hanger 16 stops at the 2nd water-washing tank 308 for a predetermined time (for example, 1 minute), then, moves into the pre-treatment tank 310.

At the pre-treatment tank 310, the transport hanger 16 stops for a predetermined time (for example, for 5 minutes), and the pre-treatment solution is applied to the plate-like work 10 from both sides.

Next, at the 3rd water-washing tank 312, water-washing process is performed by applying water to the plate-like work 10 from both sides. The transport hanger 16 stops at the 3rd water-washing tank 312 for a predetermined time (for example, 1 minute).

Then, until arriving at the electroless copper plating tank 200 (FIGS. 3 and 4), it repeats the back and forth movement a predetermined number of times as mentioned below. The processing solution Q may not be reached to the plate-like work 10 because air (bubble) remains there, if there are holes such as through holes, etc. on the plate-like work 10. Therefore, it is required to remove air (bubble) before performing an electroless copper plating process.

Figure 10:
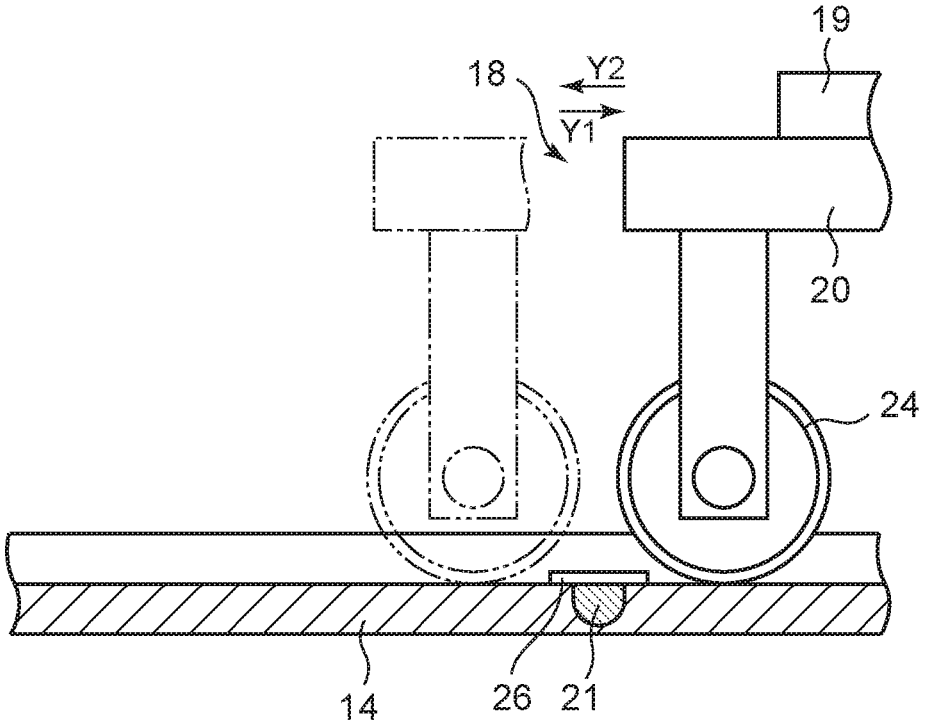
FIG. 10 shows a cross-section of a guide rail 14 between a 3rd water-washing tank 312 and the electroless copper plating tank 200.

FIG. 10 shows a cross-section surface of the guide rail 14 between the 3rd water-washing tank 312 and the electroless copper plating tank 200 (FIG. 1). As shown in FIGS. 9B and 1, one convex part 26 as an impact generator is formed on the guide rail 14. It is possible to drain off the processing solution Q by an impact caused when the transport roller 24 climbed over this convex part 26.

For example, after receiving a signal which indicates that the magnet 21 shown in FIG. 10 is arrived at the center (that is, the convex part 26 is climbed over by the transport roller 24), the PLC 30 controls the motor 28 so that the transport rollers 22, 24 move backward a predetermined distance (Y1 direction shown in FIG. 10). Then, the transport rollers 22, 24 move forward until detecting the magnet 21 (Y2 direction shown in FIG. 10). After repeating the above-mentioned back and forth movement a predetermined number of times (for example, 3 times back and forth), it stops at the center of the electroless copper plating tank 200 (FIG. 4).

The transport hanger 16 stops for a predetermined time in the electroless copper plating tank 200, and electroless copper plating solution is applied to the plate-like work 10 from both sides.

For example, the PLC 30 brings the motor 28 to a halt for 5 minutes after receiving a signal from the magnetic sensor 19 that indicates the arrival at the center of the electroless copper plating tank 200. Then, the transport rollers 22, 24 move forward by switching on the motor 8.

Then, at the 4th water-washing tank 314, a water-washing process is performed by applying water to the plate-like work 10 from both sides. The transport hanger 16 stops at the 4th water-washing tank 314 for a predetermined time (for example, 1 minute), after that, it is transferred to the unload section 316.

At last, the transport hanger 16 transferred to the unload section 316 stops. For example, the PLC 30 brings the motor 8 to a halt after receiving a signal from the magnetic sensor 19 that indicates the arrival at the unload section 316. After that, the plate-like work 10 is unloaded by the operator, etc. In this way, a series of the electroless plating process will be completed.

In the above embodiments, the surface treating apparatus 300 includes a plural of tanks (Such as the 1st water-washing tank 304, the desmear tank 306, the pre-treatment tank 310, and the electroless copper plating tank 200 shown FIG. 1). However, the surface treating apparatus 300 may include at least any one tank of them.

In the above embodiments, electroless copper plating is performed on the plate-like work 10 in the surface treating apparatus 300. However, the other electroless plating may be performed on the plate-like work 10 (for example, electroless nickel plating, electroless tin plating, electroless gold plating, etc.).

Figure 11A:
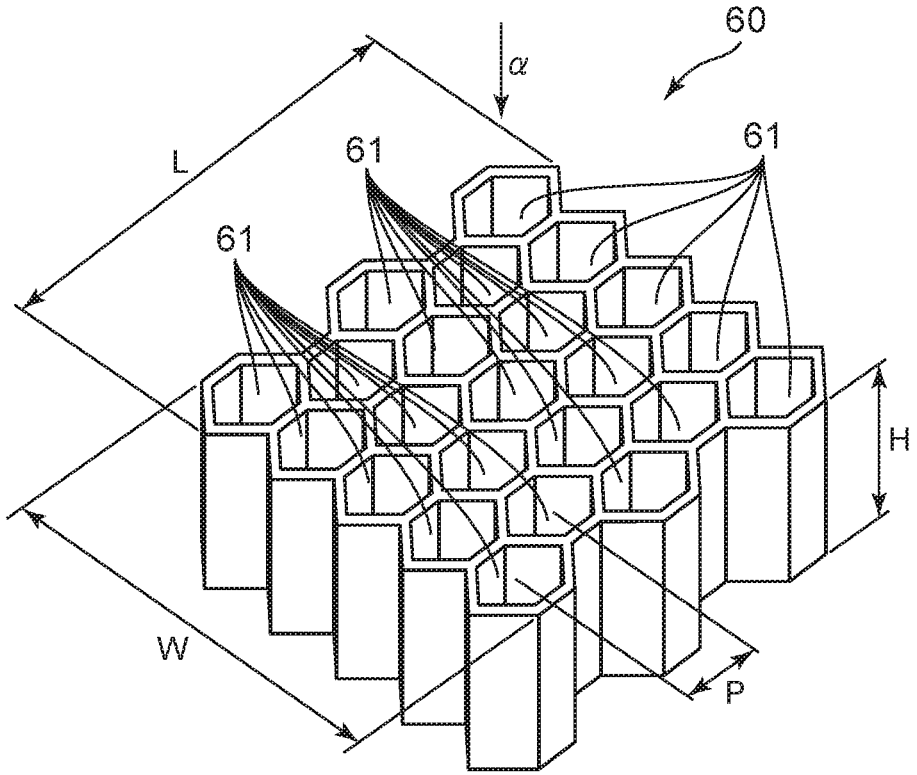
FIGS. 11A and 11B show details (a perspective view and an enlarged view of a main part) of an anti scattering member 60.
Figure 11B:
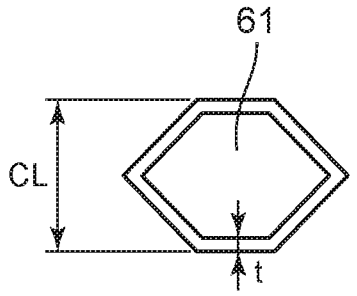

The antiscattering member 60 will be described with reference to FIG. 11. The antiscattering member 60 consists of a plurality of tubular members with hexagonal holes connected together. In addition, as for a form of the anti scattering member 60, the present invention is not limited to the form described above, and it may employ a form having honeycomb-like structure where a plurality of polygonal or circular tubular members other than hexagonal tubular members are arranged as the antiscattering member 60, that is, a form having a plurality of vertically long individual tubular members that are arranged so that their openings are oriented to face the vertical direction. This is because, as will be described later, it is sufficient that droplets pass through smoothly.

With such a honeycomb member, it is possible to reduce the reflection of the droplets splashed on the surface of the processing solution Q. This is due to the following reason. The droplet that have passed through a through-hole (not shown) of the antiscattering member 60 is partly reflected by the surface of the processing solution Q. At this time, a part of the reflected droplet is reflected obliquely and thus collides with an inner wall of the through-hole of the antiscattering member 60. This is because the amount of the reflected droplets passing through the through-holes reversely is reduced by such a mechanism.

In case of using a conventional sponge or fibrous material and the like, scattering after passing through the antiscattering member can be prevented, but there remains a problem that scattering on the surface of the antiscattering member is large. The antiscattering member 60 can reduce such scattering on the surface.

Note that some scattering occurs on the surface of the antiscattering member 60. In order to prevent such scattering, a film forming mechanism 110 may be employed on an inlet side and an outlet side of each treatment chamber as shown in FIG. 12. In FIG. 12, the suspension mechanism for the plate-like work 10 is omitted.

Figure 12B:
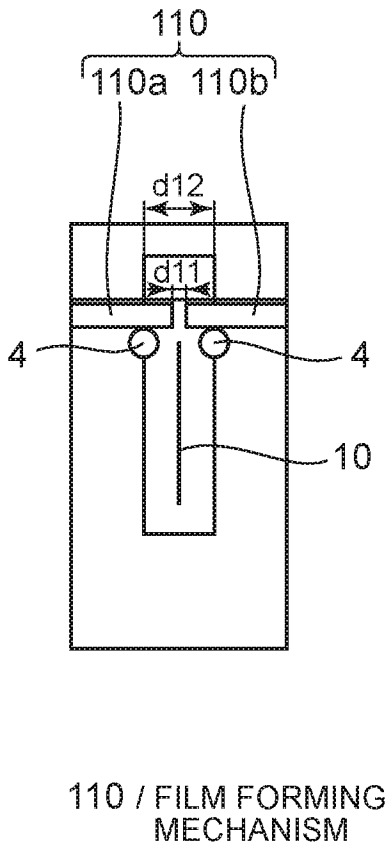
FIGS. 12A and 12B are diagrams for explaining an arrangement position of a film forming mechanism 110.

Herein, the film forming mechanism 110 will be described. As shown in FIG. 12B, the film forming mechanism 110 includes a film forming mechanism 110*a* and a film forming mechanism 110*b*.

Then, the film forming mechanism 110*a* will be described. Although shown in FIG. 12A as a rectangle, in reality, as shown in FIG. 13 (perspective view), the film forming mechanism 110*a* is formed with a nozzle 111 extending in a longitudinal direction as a convex part. A continuous laminar liquid (water or processing solution) under pressure of about 0.01 MPa is ejected from the nozzle 111 at a flow rate of 5 to 10 L/min. Thereby, a liquid film 113*a* shown in FIG. 13 is formed. The same applies to the film forming mechanism 110*b*.

As shown in FIG. 12B, the film forming mechanism 110*a* and the film forming mechanism 110*b* are spaced apart by a distance d11. This is because, in the surface treating apparatus 300, the plate-like work 10 is transported into the treatment chamber in a suspended state, and thus a width that allows the relevant mechanism to pass through is required.

Figure 12A:
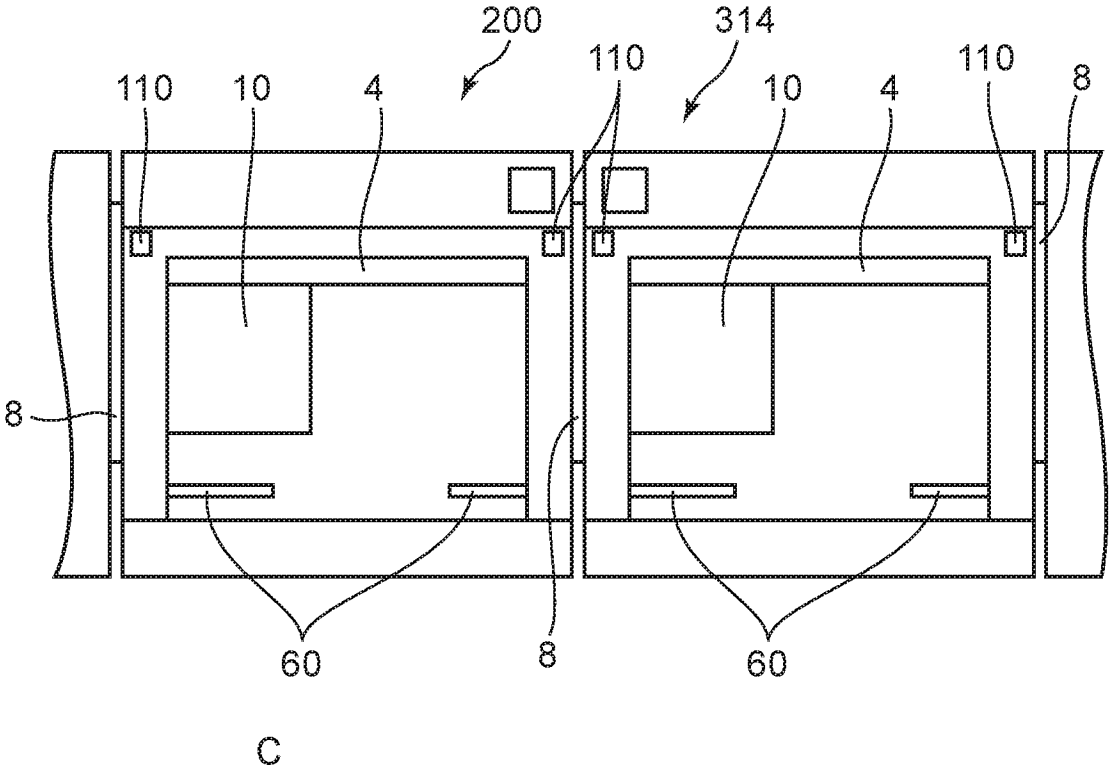
Figure 13:
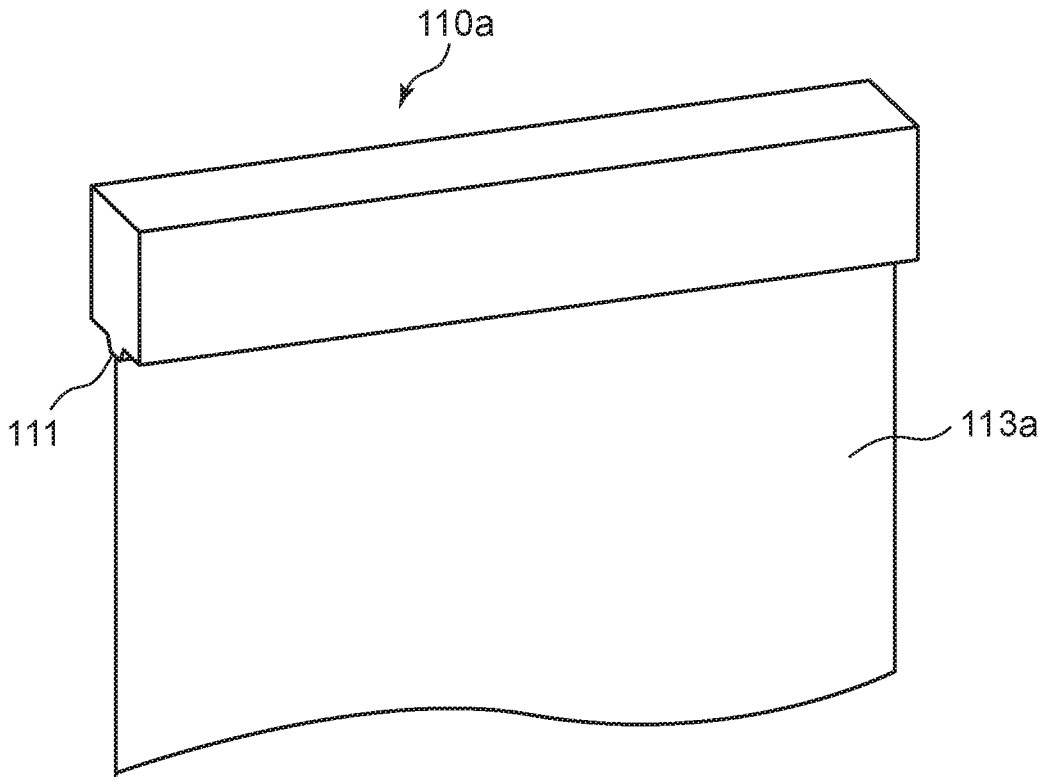
FIG. 13 is a schematic perspective view of a film forming mechanism 110*a*.

In FIG. 12A, the plating solution is ejected in the electroless copper plating tank 200, and the water is squirted in the 4th water-washing tank 314. In this embodiment, the Water Knife WK type nozzle manufactured by Kyoritsu Alloy Manufacturing Co., Ltd. is used as the film forming mechanism 110*a* and the film forming mechanism 110*b*, but is not limited thereto.

The liquid ejected from the film forming mechanism 110*a* and the film forming mechanism 110*b* prevents the droplets reflected on the surface of the antiscattering member 60 from splashing and entering the adjacent treatment chamber.

In the present embodiment, the film forming mechanism 110 is employed on the inlet side and the outlet side of each treatment chamber, but either one may be employed.

In the present embodiment, the distance d11 can be made smaller than a width d12 of the slit 8. This is because, when the plate-like work 10 is shaken larger than the distance d11 to collide with a film formed by the film forming mechanism 110, the film flows down along the plate-like work 10 since the film is liquid. This also has an effect of converging the shaking of the plate-like work 10.

Moreover, the film reduces the air flow in a transport direction in each process chamber. This is because the opening can be made narrower than the width d12 of the slit, and accordingly, the air flowing into the treatment chamber from the outside can be prevented.

In the present embodiment, the film forming mechanism 110 is employed in order to prevent scattering on the surface of the anti scattering member 60. However, the film forming mechanism 110 can be applied not only to a case that another antiscattering member is employed but also to a surface treating apparatus that includes no scattering prevention mechanism. The latter includes, for example, a surface treating apparatus having no scattering prevention mechanism in which the droplets splash on the surface of the processing solution Q stored under the plate-like work 10, and a surface treating apparatus having no scattering prevention mechanism in which the droplets splash on the bottom surface.

2. Second Embodiment

A surface treating apparatus 410 having a mechanism for flowing air downwards in the treatment chamber will be described with reference to FIG. 14.

Figure 14:
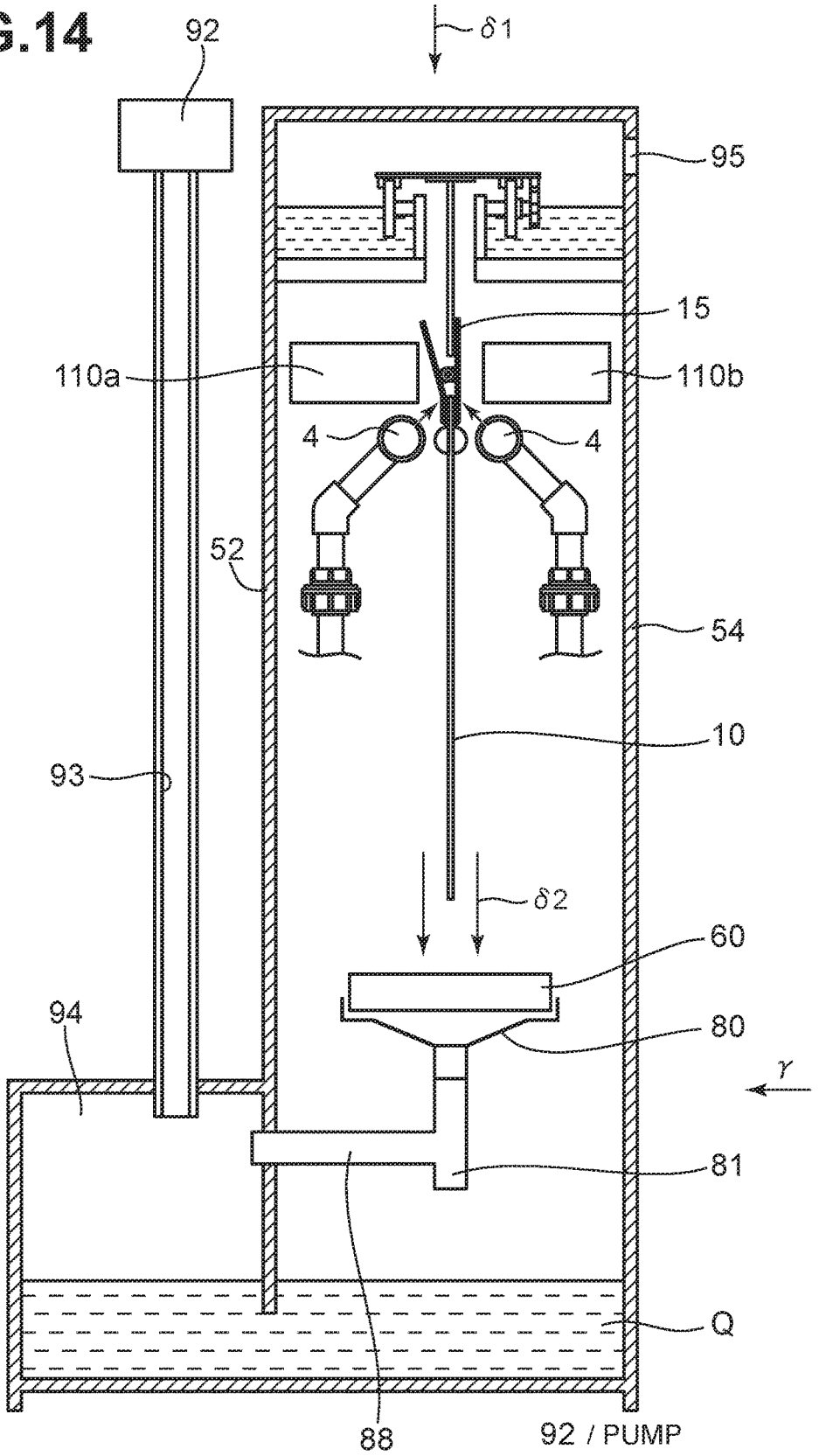
FIG. 14 is a front view of a surface treating apparatus 410.
Figure 15:
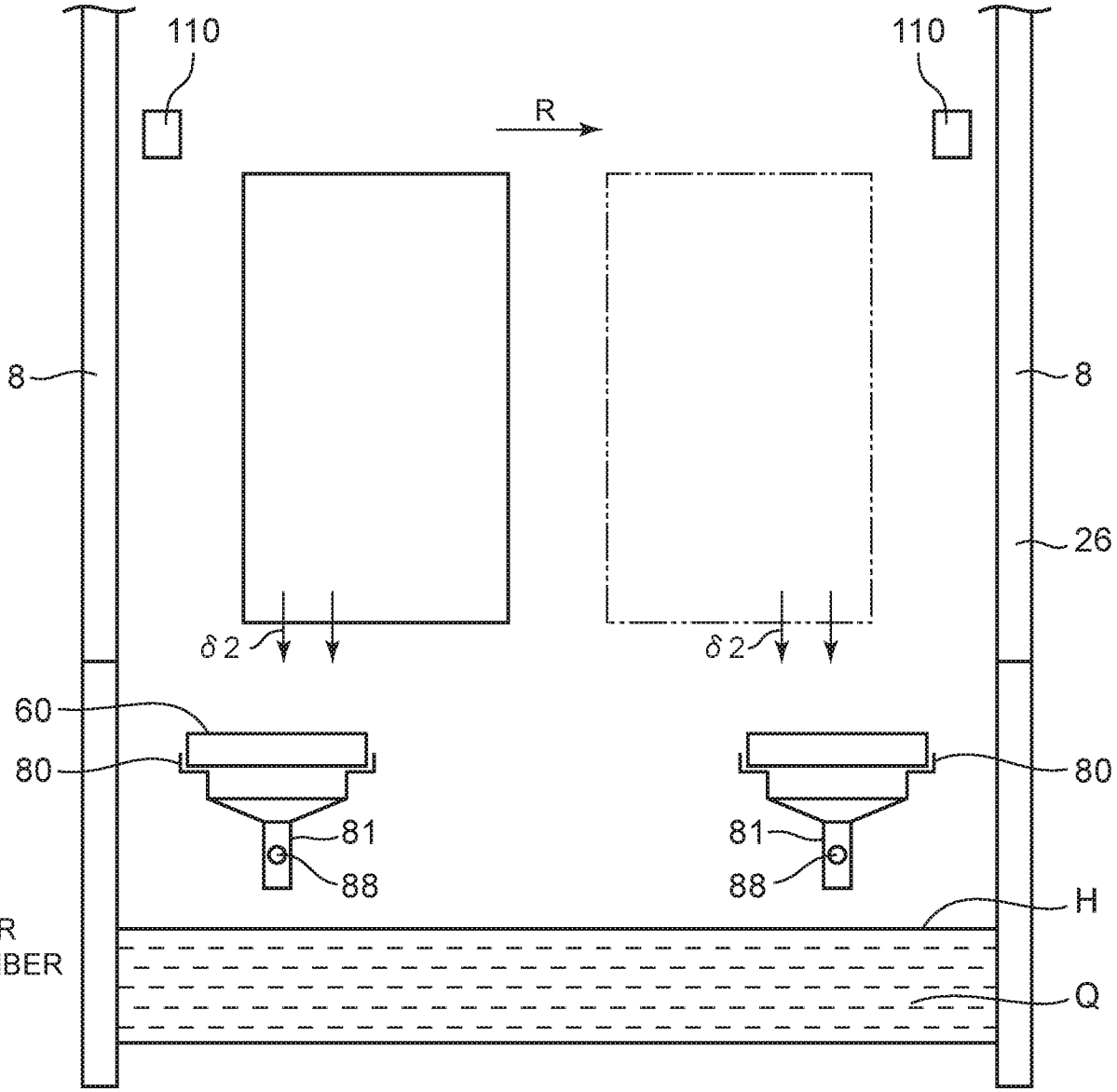
FIG. 15 is a diagram showing positional relationship between a plate-like work 10 and a tray 80 as viewed from a direction of an arrow γ in FIG. 14.

In the present embodiment, a tray 80 having a shape as shown in FIG. 14 is provided underneath the antiscattering member 60 to control the air flow. FIG. 15 is a view as seen from a direction of an arrow γ in FIG. 14. In FIG. 15, for ease of understanding, a frame 54 is not illustrated.

As shown in FIG. 15, two trays 80 are provided below the plate-like work 10 in a vicinity of each slit 8. This is to reduce an amount of jumping out liquid to the adjacent treatment chamber in the vicinity of the slit 8. Since the film forming mechanisms 110*a* and 110*b* are the same as those in the first embodiment, their description will be omitted.

Figure 16:
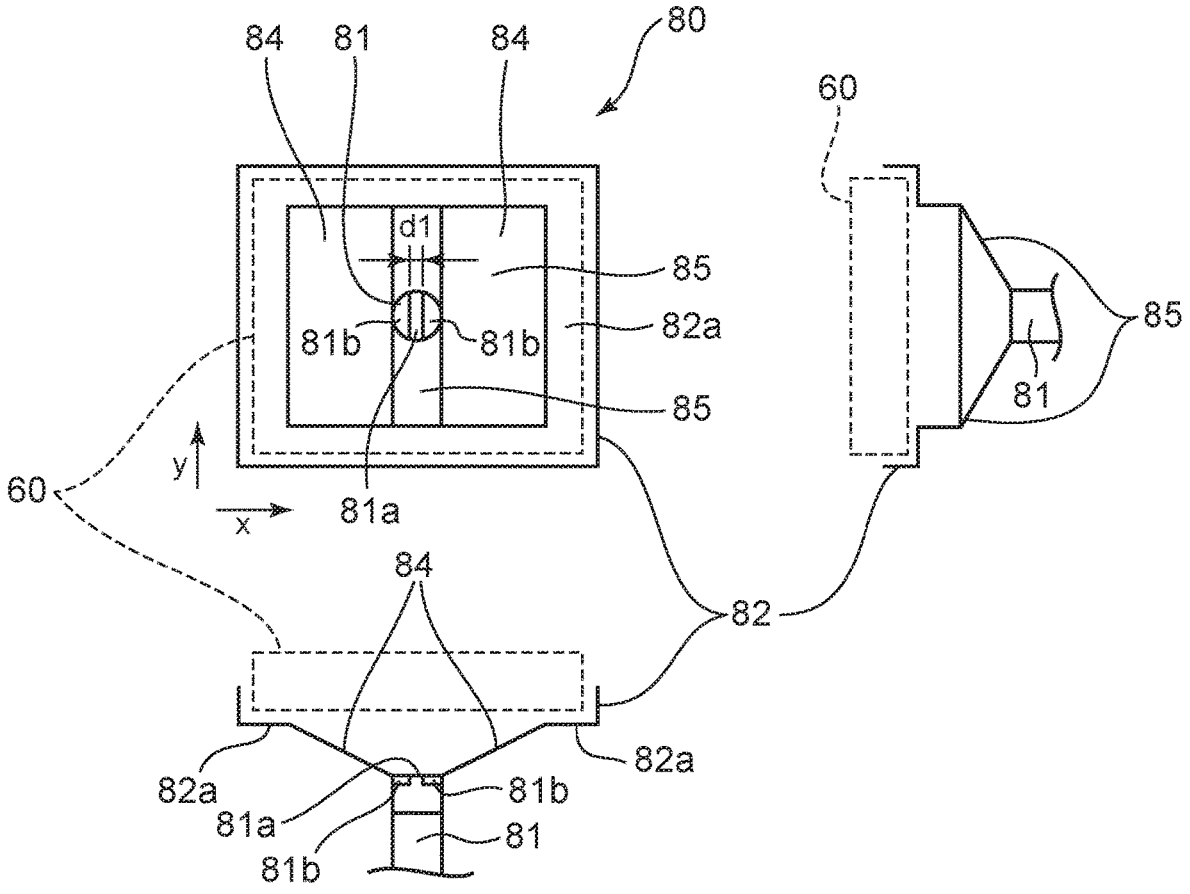
FIG. 16 is a diagram showing details of the tray 80.

The shape of the tray 80 will be described with reference to FIG. 16. In FIG. 16, for ease of explanation, a relative position of the antiscattering member 60 is shown by a broken line. A flat surface 82*a* is formed continuously at a lower end of a frame 82. A slope 84 is formed in an x direction from an inner end of the flat surface 82*a*. A slope 85 is formed in a y direction from an end of the slope 84. In addition, a pair of lids 81*b* are fitted to an upper edge of a vertical pipe member 81 so that a slit 81*a* is formed.

In the present embodiment, a width d1 of the slit 81*a* between the two slopes 84 is about 2 mm. Such width may be determined so that an allowable amount that the vertical pipe member 81 can suck per unit time becomes larger than an amount of liquid collected by the tray 80 per unit time. However, if the width d1 is made too large, flow velocity decreases when the suction air flow rate (amount Q=opening area A*flow velocity V) remains constant, so it is desirable to set the width d1 to 5 mm or less.

Figure 17:
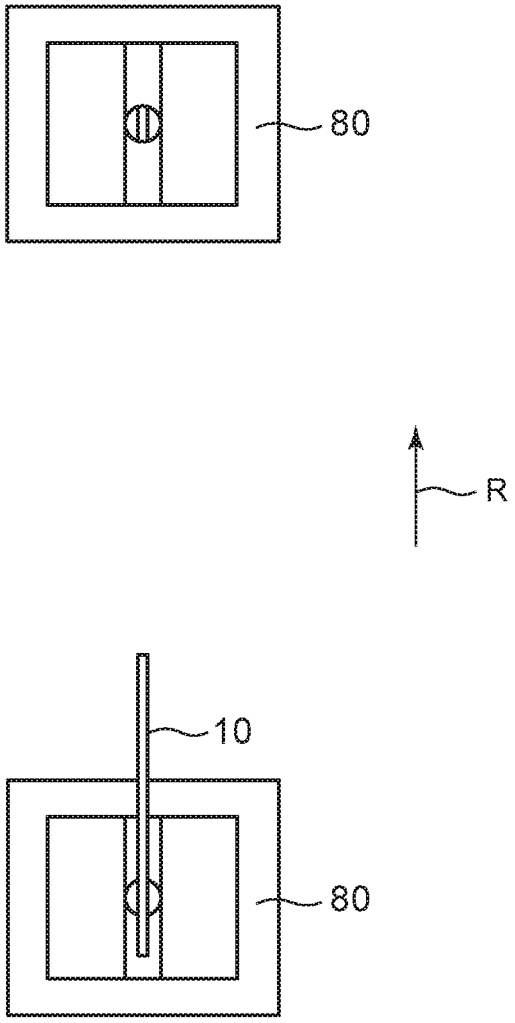
FIG. 17 is a diagram showing the positional relationship between the plate-like work 10 and the tray 80 as viewed from a direction of an arrow δ1.

FIG. 17 shows an arrow view from a direction of an arrow δ1 in FIG. 14. When viewed from above, the trays 80 is arranged such that the slopes 84 are located on both sides of the plate-like work 10 and a direction of a groove formed by the lower ends of the two slopes 84 is parallel to the plate-like work 10.

A vertical pipe member 81 is connected to the lower end of the slope 85. As shown in FIG. 14, a horizontal pipe member 88 is connected to the middle of the vertical pipe member 81 so as to communicate therewith.

In the present embodiment, suction is performed by a pump 92 provided at an end of a pipe 93 so that a chamber 94 is kept in a negative pressure state.

An air intake 95 is provided in an upper part of the treatment chamber. Therefore, the air taken in from the air intake 95 by the suction flows from the through-holes 61 of the antiscattering member 60 through the slopes 84 and 85 to the vertical pipe member 81 and the horizontal pipe member 88. Then, together with the collected liquid, the air is discharged from the horizontal pipe member 88 to the chamber 94.

As shown in FIG. 17, the tray 80 is arranged such that the slopes 84 are located on both sides of the plate-like work 10 and the direction of the groove formed by the lower ends of the two slopes 84 is parallel to the plate-like work 10. Therefore, when sucked by the pump 92, an air flow in the direction of an arrow δ2 is generated as shown in FIG. 14. As the air flow in the direction of the arrow δ2 is generated at the lower part of the plate-like work 10, the air flow also contributes to stabilize the posture of the thin plate-like work 10.

In this embodiment, the tray 80 is provided under the antiscattering member 60, but a member other than the antiscattering member 60 may be used. Also, the tray 80 may be provided without the antiscattering member 60.

The tray 80 may have a different shape as long as the air easily flows on the side surfaces of the plate-like work 10 in the vertical direction.

In the present embodiment, the slit 81*a* is formed by the pair of lids 81*b*, but other methods such as adopting a pipe which is partly formed to have the shape of the slit 81*a* may be used.

Figure 18A:
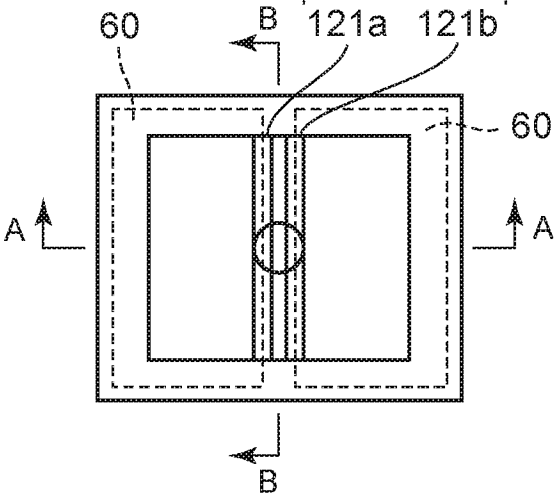
FIGS. 18A, 18B, 18C and 18D are diagrams illustrating an embodiment in hick a guiding part 120 is provided.
Figure 18B:
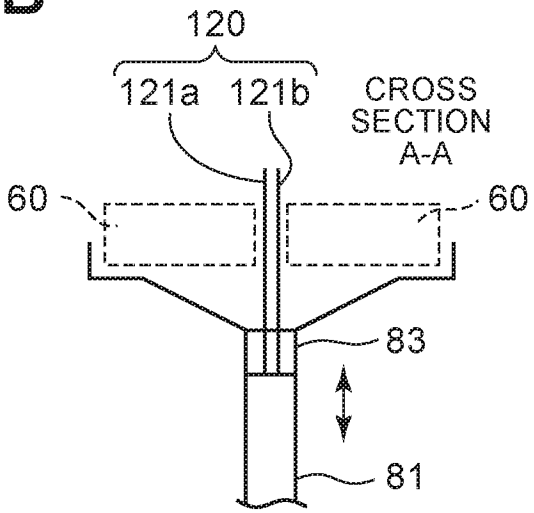
Figure 18C:
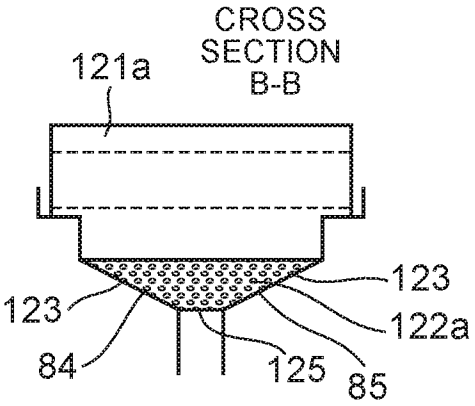
Figure 18D:
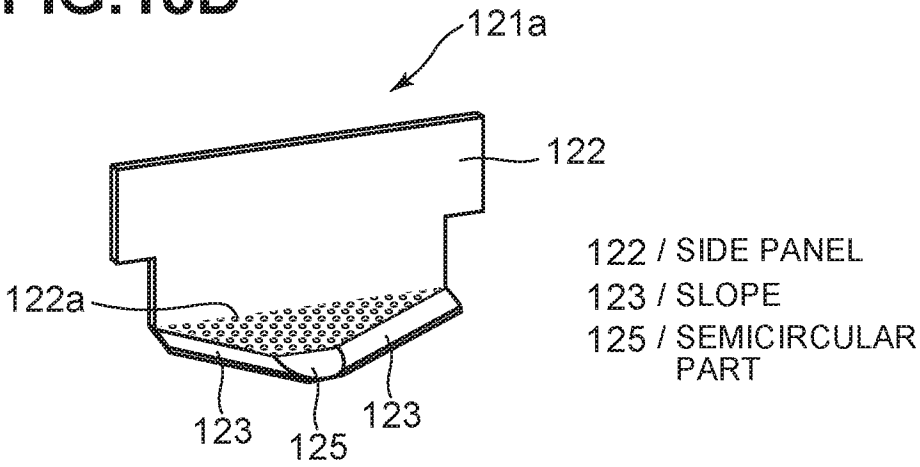

FIG. 18A shows an embodiment in which a guiding part 120 for air suction is provided. A cross section A-A and a cross section B-B in FIG. 18A are shown in FIGS. 18B and 18C respectively. The guiding part 120 is composed of lids 121*a* and 121*b*. A perspective view of the lid 121*a* is shown in FIG. 18D. The lid 121*a* has a side panel 122, slopes 123, and a semicircular part 125. The side panel 122 is provided with a plurality of through-holes 122*a*. The lid 121*b* is symmetrical with the lid 121*a*.

By mounting the lids 121*a* and 121*b* on the tray 80, the slopes 84 and 85 and the slopes 123 are combined and held together, and the vertical pipe member 81 is partially blocked by the semicircular part 125. Also, the antiscattering member 60 is divided into two, and a gap having the width d1 between the side walls 122 is formed on the vertical pipe member 81. Thereby, since a suction port can be located closer to the plate-like work 10, suction force can be enhanced. Moreover, since the suction port can be narrowed, the flow velocity of the air below the plate-like work 10 can be increased. Thereby, the splash of droplets can be reduced.

Note that the problem of droplets being accumulated in the tray 80 by the lids 121*a* and 121*b* can be solved by providing the through-holes 122*a*. A position and number of the through-holes 122*a* may be designed according to the amount of the liquid accumulated in the tray 80.

In FIG. 18, the lids 121*a* and 121*b* having the side walls 122 are adopted. However, if a holding mechanism is provided separately, the slopes 123 are not essential. Further, the side walls 122 may be omitted. Even in this case, since the suction port can be narrowed by lids formed only of the semicircular parts 125, the flow velocity of the air below the plate-like work 10 can be increased.

Depending on the shape of the plate-like work 10, a distance between the plate-like work 10 and the tray 80 may vary. In this case, as shown in FIG. 18B, the tray 80 may be configured to be slidable in the vertical direction. For this height adjustment, a pipe member 83 having an outer diameter nearly equal to an inner diameter of the vertical pipe member 81 may be provided at the lower portion of the tray 80, or a bellows structure may be used. A well-known mechanism may be employed as a mechanism for slidably holding the height of the tray 80.

In the present embodiment, controlled air velocity in the treatment chamber is kept to be from 0.2 to 0.5 m/s by adjusting the suction by the pump 92. By setting the air velocity to this extent, the splash on the surface of the anti scattering member 60 can be reduced while stabilizing the posture of the plate-like work 10.

Note that the controlled air velocity in the treatment chamber is not limited to the above-described range.

The air intake 95 and the pump 92 may be provided in each treatment chamber. Accordingly, there remains almost no air flow in a direction of an arrow R in FIG. 15 (air flow toward the opening 8) in the treatment chamber, and the air flow is oriented substantially vertically, so that even the posture of the thin plate-like work is stabilized.

Further, a lower end surface of the frame 52 is located lower than the processing solution Q. Therefore, communication of air to the chamber 94 is performed through the vertical pipe member 81 and the horizontal pipe member 88.

Note that if the substrate is thinner than 40 μm, even if there exists a downward air flow in the treatment chamber, the substrate may be shaken if there exists an air flow in a direction perpendicular thereto. Such a problem occurs at a position where exposure to the processing solution from a liquid squirting part 4 does not take place. However, in the present embodiment, since the air flow in the direction perpendicular to the downward air flow in the treatment chamber can be reduced, even such a thin substrate can be stably transported.

As in the second embodiment, in the case where the air flow is controlled to be substantially vertical in each treatment chamber, by using the film forming mechanism 110, the air flow in a direction parallel to a proceeding direction of the substrate flowing in from the slit 8 can be reduced. Therefore, even the thin plate-like work can be stably transported in each treatment chamber.

By providing such a kind of liquid film curtain, the area of the opening can be reduced, and an effect of push-pull exhaust in the vertical direction is enhanced, so that the suction of outside air and the shaking of the thin plate-like work can be hardly allowed. Furthermore, there is an effect that mist in the treatment chamber is hardly leaked to the outside.

3. Third Embodiment

Figure 19:
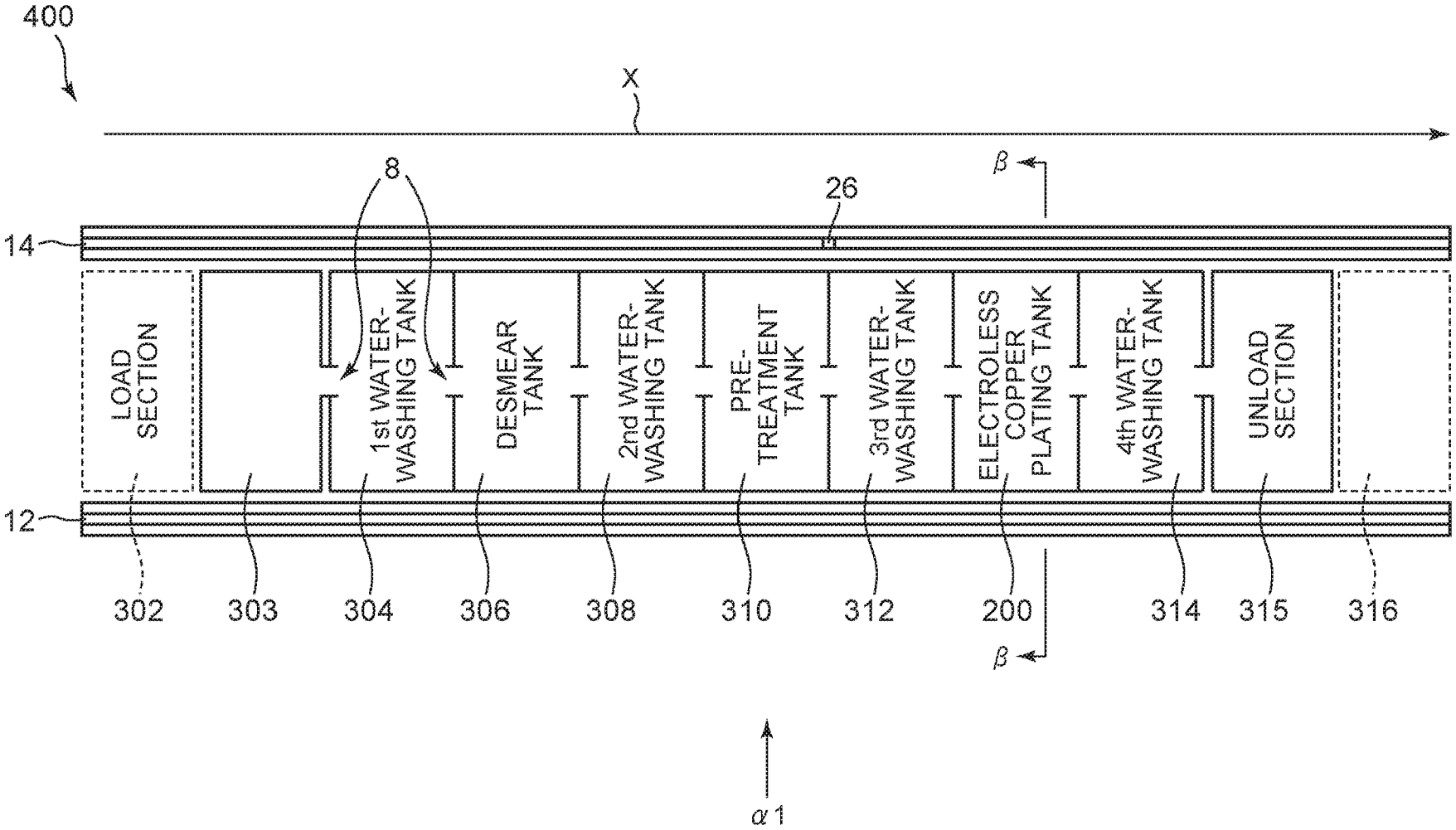
FIG. 19 is an arrangement plan of a surface treating apparatus 400 seen from above.

In the above-described embodiment, the case where the film forming mechanism 110 is provided in each treatment chamber has been described. However, in the third embodiment, as illustrated in FIG. 19, a front tank 303 and a rear tank 315 are provided on a loading side and an unloading side of a surface treating apparatus 400 respectively, and the film forming mechanism 110 is employed in each of them. Since the film forming mechanism 110 is the same as that in the above-described embodiment, the description thereof is omitted. In this case, a water film may be employed for both the front tank 303 and the rear tank 315.

Figure 20B:
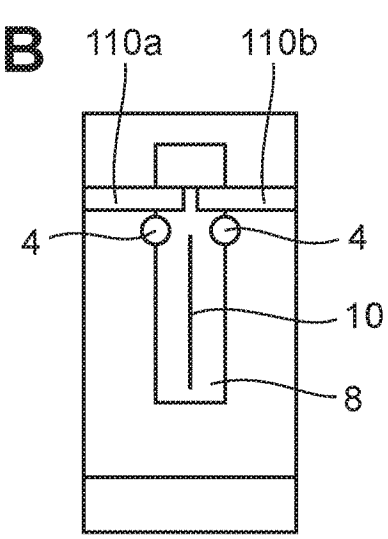
FIGS. 20A, 20B, 20C, and 20D are diagrams showing the film forming mechanism 110 provided in treatment tanks 303 and 315.
Figure 20D:
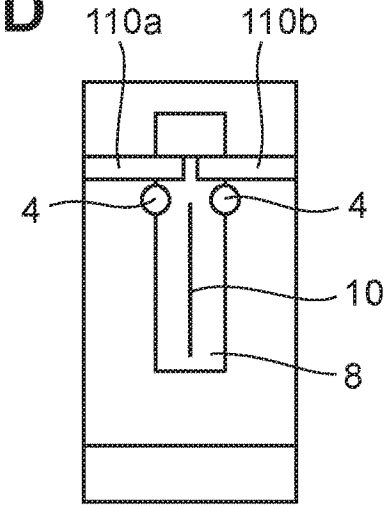
Figure 20A:
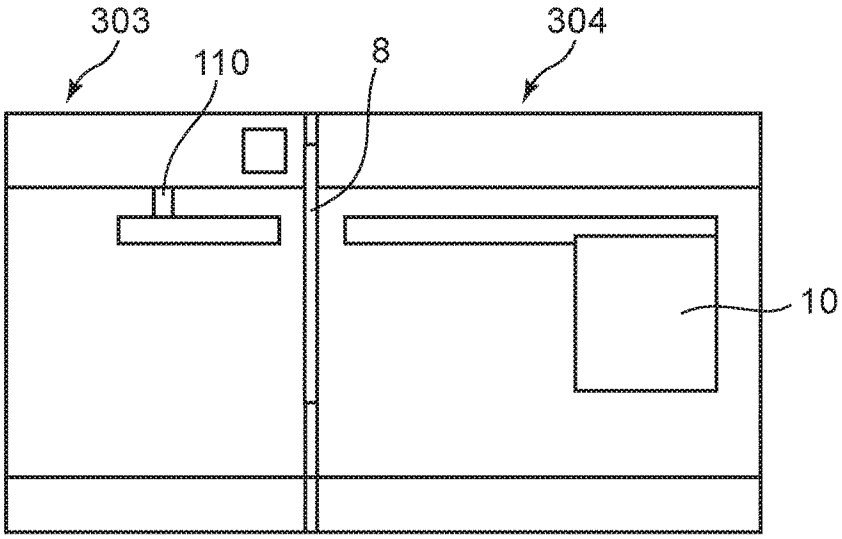

An arrangement position of the film forming mechanism 110 in the front tank 303 is shown in FIGS. 20A and 20B. Thus, the film forming mechanism 110 is provided in the front tank 303 between the load section 302 and the first water-washing tank 304. Accordingly, the suction of outside air from the load section side is prevented.

Figure 20C:
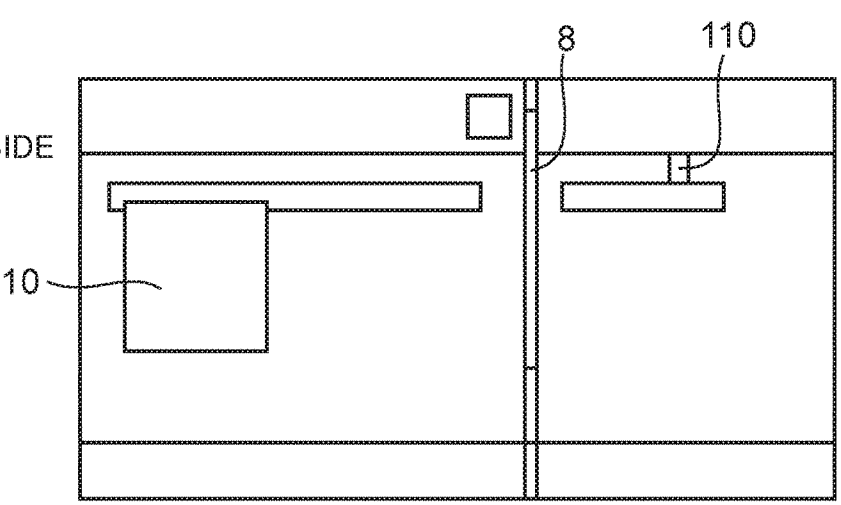

The arrangement position of the film forming mechanism 110 in the rear tank 315 is shown in FIGS. 20C and 20D. Thus, the film forming mechanism 110 is provided in the rear tank 315 between the unload section 316 and the fourth water-washing tank 314. Accordingly, the suction of outside air from the unload section side is prevented.

In this way, the inside of the load section 302 and the inside of the unload section 316 are provided with a thin layered liquid film along the direction of gravity on a plane orthogonal to a direction in which the plate-like work 10 is carried, so that the suction of outside air can be prevented.

4. Fourth Embodiment

Figure 21A:
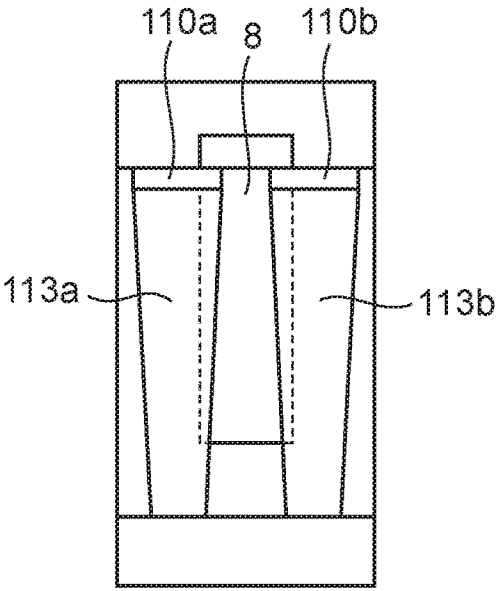
FIGS. 21A, 21B, 21C, and 21D are diagrams showing an embodiment in which the film forming mechanism 110 is inclined.
Figure 21B:
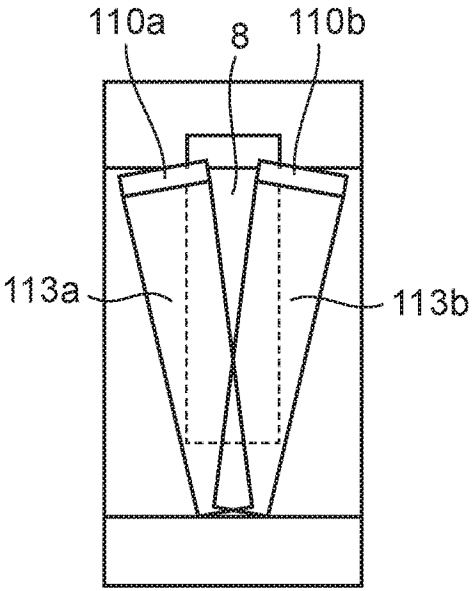
Figure 21C:
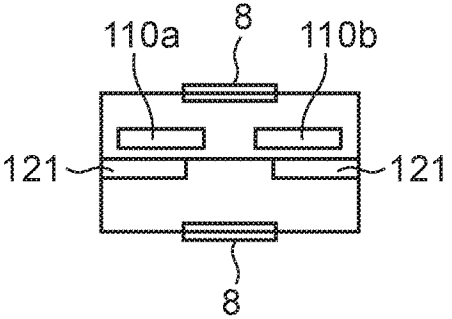
Figure 21D:
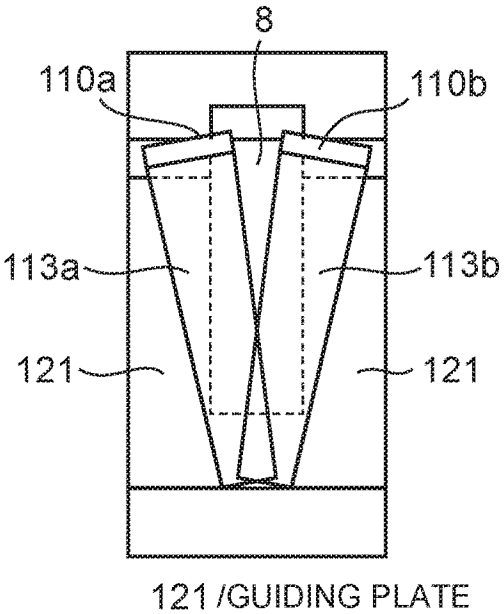

In each of the above-described embodiments, the film forming mechanism 110 is provided substantially horizontally. In this case, as the formed liquid films 113*a* and 113*b* move downwards, their widths are narrowed toward their center lines due to an influence of surface tension of a free-falling liquid (see FIG. 21A). In order to solve such a problem, as shown in FIG. 21B, the film forming mechanisms 110*a* and 110*b* may be arranged to be inclined toward the center line between the film forming mechanisms. Thereby, the gap between the formed liquid films 113*a* and 113*b* is reduced.

In this case, corresponding to the inclination, gaps are formed between the outer edges of the liquid films 113*a* and 113*b* and the side walls of the tank body. Therefore, guiding plates 121 may be provided to fill the gaps (see FIGS. 21C and 21D). The guiding plate 121 not only fills the gaps, but also has an effect to form the liquid film more easily by the surface tension caused by the liquid flowing over the guiding plate 121.

5. Other Embodiments

Figure 22:
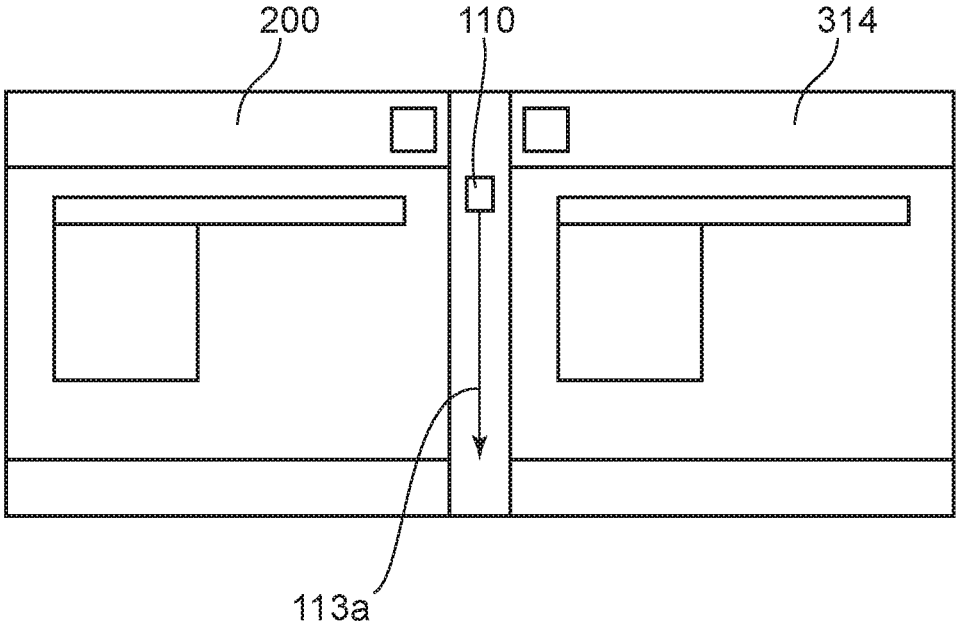
FIG. 22 is a diagram showing an embodiment in which the film forming mechanism 110 is provided outside the treatment chamber.

In the first and second embodiments, two film forming mechanisms 110 are arranged in the vicinity of the inlet and the outlet in each treatment chamber. However, as shown in FIG. 22, one film forming mechanism 110 may be provided between the treatment chambers. Thereby, the number of film forming mechanisms 110 can be reduced, and water can be ejected from all the film forming mechanisms. In addition, the formed liquid film securely prevents droplets from mixing into the adjacent treatment chamber, so that a length of each treatment chamber can be shortened accordingly.

In addition, when the film forming mechanism 110 is provided outside the treatment chamber, water recovery is required separately. To solve this problem, for example, the water ejected from all the film forming mechanisms may be circulated together.

In each of the above-described embodiments, the film forming mechanism 110 is arranged at substantially the same height as the clamp 15. Although it is more preferable to arrange the film forming mechanism 110 slightly higher than the clamp 15, the film forming mechanism 110 may be also arranged higher or lower than the clamp 15. The same applies to positional relationship with the liquid squirting part 4.

For example, in each of the above-described embodiments, the pair of film forming mechanisms 110*a* and 110*b* are arranged with a width that allows the clamp 15 holding the film forming mechanism 110 to pass through. However, the width can be narrowed by arranging the film forming mechanism 110 (higher or lower) to avoid interference with the clamp 15.

In the surface treating apparatus according to the present invention, the film forming mechanism is provided in the vicinity of the carry-in opening, in the first treatment chamber or in the second treatment chamber. This makes it possible to provide the flow down type surface treating apparatus that enables downsizing without the liquid being mixed into the adjacent treatment chamber.

The surface treating apparatus according to the present invention includes an air flow rate control mechanism that controls air to flow in a vertical direction along two planes of the sheet-like treatment object. The film forming mechanism reduces air flowing in from the carry-in opening that collides with the air flow in the vertical direction.

In the surface treating apparatus according to the present invention, the liquid film is composed of the same liquid that is squirted to flow down over the sheet-like treatment object in the relevant treatment chamber. This makes it possible to collect the liquid by using a same collecting mechanism in the treatment chamber.

In the surface treating apparatus according to the present invention, the liquid film has a film opening narrower than the carry-in opening. This makes it possible to reduce the air flowing in from the carry-in opening that collides with the air flow in the vertical direction.

In the surface treating apparatus according to the present invention, the film opening is wider than a width of a holding part that holds the sheet-like treatment object. This makes it possible to arrange the film forming mechanism avoiding the holding part that holds the sheet-like treatment object.

In the surface treating apparatus according to the present invention, thickness of the sheet-like treatment object is 40 μm or less. This makes it possible to stably transfer even such a substrate that is susceptible to the air flow.

In the surface treating apparatus according to the present invention, the film opening is formed by arranging a pair of discharge parts apart from each other. This makes it possible to secure a space for transportation when transporting the sheet-like treatment object by a suspension system.

In the surface treating apparatus according to the present invention, the pair of discharge parts discharges the liquid obliquely so as to face the film opening. This makes it possible to prevent the liquid film from moving away each other as going downward due to surface tension.

The surface treating apparatus according to the present invention includes a guiding plate that is spaced wider than the carry-in opening and guides the liquid film. This makes it possible to facilitate the formation of the liquid film.

In the surface treating apparatus according to the present invention, the air flow rate control mechanism includes an air suction port and a height adjustment mechanism that adjusts a distance between the air suction port and the treatment object. This makes it possible to adjust the distance between the suction port and the treatment object according to the size of the treatment object.

In the surface treating apparatus according to the present invention, a plurality of treatment chambers are arranged in series in which the sheet-like treatment object is carried in the vertically held state via the carry-in openings, and in each of the treatment chambers, a predetermined processing solution is squirted to flow down from an upper portion of a surface area of the vertically held treatment object that is carried in so that a predetermined surface treatment is applied to the surface of the treatment object. Among the treatment chambers, the film forming mechanisms are provided on the inside of the carry-in opening of the treatment chamber on the inlet side and/or the inside of the carry-in opening of the treatment chamber on the outlet side, wherein the film forming mechanism forms a thin layered liquid film along a direction of gravity on a plane orthogonal to a direction in which the treatment object is carried. This makes it possible to reduce the air flowing into each treatment chambers. Thereby, the posture of the sheet-like treatment object is stabilized.

In the surface treating apparatus according to the present invention, each of the treatment chambers includes an air flow rate control mechanism for controlling the air to flow in the vertical direction along two planes of the sheet-like treatment object. This makes it easier to stabilize the posture of the sheet-like treatment object.

Although the present invention has been described as a preferred embodiment in the foregoing, it has been used not for purposes of limitation but for purposes of illustration.

Therefore, changes can be made within the scope of the claims without surpassing the scope and the spirit of the present invention.

DESCRIPTION OF REFERENCE NUMERALS

8: slit
10: plate-like work
110: film forming mechanism
113*a*, 113*b*: liquid film

What is claimed is:

1. A surface treating apparatus comprising:

a first treatment chamber in which a sheet-shaped treatment object is carried in a vertically held state;

a first processing solution flow down mechanism, provided in the first treatment chamber, for squirting a first processing solution to flow down from an upper portion of the carried sheet-shaped treatment object over a surface region of the vertically held sheet-shaped treatment object;

a second treatment chamber adjacent to the first treatment chamber in which the sheet-shaped treatment object is carried in a vertically held state;

a second processing solution flow down mechanism, provided in the second treatment chamber, for squirting a second processing solution to flow down from the upper portion of the carried sheet-shaped treatment object over a surface region of the vertically held sheet-shaped treatment object;

a partition wall, provided between the first treatment chamber and the second treatment chamber, having a carry-in opening that enables the sheet-shaped treatment object to be carried in through the carry-in opening in the vertically held state; and a film forming mechanism provided between the first processing solution flow down mechanism in the first treatment chamber and the second processing solution flow down mechanism in the second treatment chamber that forms a thin layered liquid film along a direction of gravity on a plane orthogonal to a direction in which the sheet-shaped treatment object is carried.

2. The surface treating apparatus according to claim 1, wherein the film forming mechanism is provided in the first treatment chamber or the second treatment chamber in a vicinity of the carry-in opening.

3. The surface treating apparatus according to claim 2, further including an air flow rate control mechanism that controls air to flow in a vertical direction along the two planes of the sheet-shaped treatment object.

4. The surface treating apparatus according to claim 1, wherein the liquid film is composed of a same liquid that is squirted to flow down over the sheet-shaped treatment object in the treatment chamber.

5. The surface treating apparatus according to claim 1, wherein the liquid film has a film opening narrower than the carry-in opening.

6. The surface treating apparatus according to claim 5, wherein the film opening is wider than a width of a holding part for holding the sheet-shaped treatment object.

7. The surface treating apparatus according to claim 1, wherein a thickness of the sheet-shaped treatment object is 40 μm or less.

8. The surface treating apparatus according to claim 1, wherein the film opening is formed by arranging a pair of discharge parts apart from each other.

9. The surface treating apparatus according to claim 8, wherein the pair of discharge parts discharge liquid obliquely so as to face the film opening.

10. The surface treating apparatus according to claim 1, further including a guiding plate that is spaced wider than the carry-in opening and guides the liquid film.

11. The surface treating apparatus according to claim 3, wherein the air flow rate control mechanism includes an air suction port and a height adjustment mechanism that adjusts a distance between the air suction port and the sheet-shaped treatment object.

* * * * *